US006179217B1

(12) United States Patent
Yoshida et al.

(10) Patent No.: US 6,179,217 B1
(45) Date of Patent: Jan. 30, 2001

(54) COATING METHOD FOR ROTARY ATOMIZING HEAD TYPE COATING DEVICE

(75) Inventors: Osamu Yoshida; Hidetsugu Matsuda, both of Tokyo (JP)

(73) Assignee: ABB K.K., Tokyo (JP)

( * ) Notice: Under 35 U.S.C. 154(b), the term of this patent shall be extended for 0 days.

(21) Appl. No.: 09/380,595

(22) PCT Filed: Dec. 28, 1998

(86) PCT No.: PCT/JP98/05994

§ 371 Date: Sep. 13, 1999

§ 102(e) Date: Sep. 13, 1999

(87) PCT Pub. No.: WO99/36183

PCT Pub. Date: Jul. 22, 1999

(30) Foreign Application Priority Data

Jan. 13, 1999 (JP) ..... 10-018227

(51) Int. Cl.[7] ..... B05B 17/04; B05B 15/02; B05B 3/10; B05B 5/00; A02C 31/00

(52) U.S. Cl. ..... 239/7; 239/112; 239/223; 239/305; 239/703

(58) Field of Search ..... 239/1, 7, 112, 239/223, 224, 304, 305, 3, 703; 901/43

(56) References Cited

U.S. PATENT DOCUMENTS 3,135,467 * 6/1964 Greenman ..... 239/304
4,616,593 * 10/1986 Kawamura et al. ..... 239/305
5,288,525 * 2/1994 Diana ..... 239/305
5,813,608 * 9/1998 Yoshioka et al. ..... 239/112
6,071,346 * 1/2000 Yamauchi et al. ..... 118/668

OTHER PUBLICATIONS

U.S. application No. 09/380,586, filed Sep. 09, 1999, pending.
U.S. application No. 09/380,595, filed Sep. 13, 1999, pending
U.S. application No. 09/380,587, filed Sep. 09, 1999, pending.

* cited by examiner

*Primary Examiner*—Andres Kashnikow
*Assistant Examiner*—Davis Hun
(74) *Attorney, Agent, or Firm*—Oblon, Spivak, McClelland, Maier & Neustadt, P.C.

(57) ABSTRACT

A coating method by the use of a rotary atomizing head type coating system (21), permitting to make multiple color changes in the course of a coating operation by providing a plural number of paint cartridges (35) of different colors which can be replaceably and removably loaded on the coating system. The coating method for the coating system includes: a paint cartridge loading step of setting a paint cartridge (35) of a specified color in a housing (22); a coating step of supplying paint in the loaded paint cartridge to a rotary atomizing head (30); a paint cartridge unloading step of unloading the paint cartridge (35) from the housing (22) after finishing a predetermined coating operation; and a washing step of feeding a washing fluid from an atomizing head washing device (57) to the front side of the rotary atomizing head (30) to wash away deposited residues of a previous color therefrom. Accordingly, when changing the color of paint, a coating operation in a new color can be started simply after washing the rotary atomizing head (30) from front side and replacing the paint cartridge by a new one.

3 Claims, 15 Drawing Sheets

COATING METHOD FOR ROTARY ATOMIZING HEAD TYPE COATING DEVICE

TECHNICAL FIELD

This invention relates to a coating method by the use of a rotary atomizing head type coating system, particularly suitable for use, for example, in coating vehicle bodies or the like which require changes of the paint color in the course of a coating operation.

BACKGROUND OF THE INVENTION

Generally, rotary atomizing head type paint coating systems have been in wide use for coating vehicle bodies and the like. In connection with coating operations of by a coating system of this class, there are increasing demands for measures which can reduce the amounts of paint and solvent which have to be discarded as waste each time when changing the paint color in the course of a coating operation, as well as for measures which can cope with as many paint color changes as possible.

Noteworthy as a first prior art in this regard is Japanese Laid-Open Patent Publication No. H8-229446 which discloses a rotary atomizing head type coating system incorporating measures for reducing the amounts of waste paint and solvent and for coping with an increased number of paint colors. This rotary atomizing head type coating system employs paint cartridges of different colors which can be replaceably set in position on the system according to color specifications of a coating object such as vehicle bodies or the like. This prior art coating system is not equipped with a cleaning device for washing off residues of a previous color, and there is unable to fulfill the functions as required of the coating systems of this sort.

There have also been known the so-called automatic coating systems (e.g., as described in Japanese Laid-Open Patent Publication No. S63-175662) which are configured to perform a coating operation automatically for a vehicle body or the like according to a programmed routine. In a prior art automatic coating system of this sort, which is herein referred to as a second prior art for the convenience of explanation, a plural number of paint cartridges of different colors are located in predetermined positions within a working area of a working mechanism such as a coating robot or the like, and automatically changed from one cartridge to another at the time of a change of paint color. Further, in the case of the automatic coating system of the second prior art, in order to permit replacements of paint cartridges (changes of paint color), a hose is connected to the coating system to feed a washing fluid to a rotary atomizing head of the system. Provided internally of the coating system and in communication with the washing fluid hose is a washing fluid passage leading to the rotary atomizing head. At the time of washing off residues of a previous color from the rotary atomizing head, a washing fluid is spurted toward the rotary atomizing head through the washing fluid supply hose and passage.

Further, described in an application, which was internationally published in the WIPO gazette under WO 97/3470, is an automatic coating system which is noteworthy, for example, as a third prior art. The automatic coating system according to this third prior art includes a working mechanism which is located within a coating area, a coating machine having an atomizing unit and supported on the working mechanism, a plural number of paint cartridges which are filled with paint of different colors and interchangeably mounted on the coating system, and a cartridge changing device which functions to support and interchangeably load the paint cartridges on the coating machine.

In the case of the automatic coating system of the third prior art with the arrangements just described, a hose is connected to the coating system to feed a washing fluid to the latter in a manner similar to the above-mentioned second prior art. Provided in the coating system and in communication with the washing fluid hose is a washing fluid passage leading to a rotary atomizing head of the coating system. A washing fluid valve is provided in the washing fluid passage to open and close the same.

Thus, in the above-described coating system of either the second or third prior art, which incorporates a washing device or mechanism for a rotary atomizing head, a washing fluid supply hose is connected to a washing fluid passage which is provided internally of the coating machine. Therefore, it has inherent problems such as difficulties in handling and placing the hose in evasive positions in addition to increases in scale and weight of the coating machine itself.

Besides, in case a high voltage is applied for the purpose of enhancing the paint deposition efficiency, the high voltage could leak to the outside through the washing fluid in the washing fluid passage and the hose.

DISCLOSURE OF THE INVENTION

In view of the problems of the prior art as described above, it is an object of the present invention to provide a coating method by the use of a rotary atomizing head type coating system, permitting to change the paint color at multiple points in the course of a coating operation without necessitating to discard paint as waste.

According to the present invention, in order to solve the above-described problems, there is provided a coating method by the use of a rotary atomizing head type coating system which basically includes: a housing having a coating machine mounting portion on the front side and a cartridge mounting portion on the rear side thereof; a coating machine adapted to be mounted on the coating machine mounting portion of the housing, and having an air motor with a rotational shaft and a rotary atomizing head mounted on a front end portion of the air motor; a feed tube passage hole provided internally of and axially through the rotational shaft of the air motor, and having a front end opened into the rotary atomizing head and a rear end opened into the cartridge mounting portion of the housing; and a plural number of paint cartridges having paint of different colors filled in respective cylinders, and having a feed tube extended axially forward from a front end portion of the cylinder; the coating method being characterized by a sequence comprising: a paint cartridge loading step of loading a selected one of the paint cartridges, setting the paint cartridge cylinder in position in the cartridge mounting portion of the housing, and placing the feed tube of the paint cartridge in the feed tube passage hole; a coating step of supplying paint from the loaded paint cartridge to the rotary atomizing head being put in high speed rotation; a paint cartridge unloading step of unloading the paint cartridge from the housing after finishing a predetermined coating operation; and a washing step of supplying a washing fluid to the rotary atomizing head from front side thereof to wash away deposited residues of a previous color therefrom.

According to the coating method just described, in a paint cartridge loading step, the cartridge cylinder of a color to be used firstly in a coating operation is set in position on the housing of the coating system, with a feed tube of the paint cartridge placed in the feed tube passage hole. In a next coating step, paint is supplied from the loaded paint cartridge through the feed tube to the rotary atomizing head which is put in high speed rotation by the air motor, thereby spraying the supplied paint on a coating object. Upon finishing a predetermined coating operation in the coating step, the paint cartridge is unloaded from the housing in a succeeding paint cartridge unloading step. Further, in a washing step, a washing fluid is supplied to the rotary atomizing head from the front side thereof to wash away deposited residues of a previous color in preparation for a coating operation in a new color.

Further, according to the present invention, there is provided a coating method by the use of a rotary atomizing head type coating system including: a housing having a coating machine mounting portion on the front side and a cartridge mounting portion on the rear side thereof; a coating machine adapted to be mounted on the coating machine mounting portion of the housing, and having an air motor with a rotational shaft and a rotary atomizing head mounted on a front end portion of the air motor; a feed tube passage hole provided internally of and axially through the rotational shaft of the air motor, and having a front end opened into the rotary atomizing head and a rear end opened into the cartridge mounting portion of the housing; and a plural number of paint cartridges having paint of different colors filled in respective cylinders, and having a feed tube extended axially forward from a front end portion of the cylinder; the coating method being characterized by a sequence comprising: paint cartridge loading steps of loading a selected one of the paint cartridges, setting the paint cartridge cylinder in position in the cartridge mounting portion of the housing, and placing the feed tube of the paint cartridge in the feed tube passage hole; a coating step of supplying paint in the loaded paint cartridge through the feed tube to the rotary atomizing head being put in high speed rotation; a washing step of supplying a washing fluid to the front side of the rotary atomizing head after finishing a predetermined coating operation in the coating stage to wash away deposited residues of a previous color from the rotary atomizing head and fore end portions of the feed tube; and a paint cartridge unloading step of unloading the paint cartridge from the housing after finishing washing in the washing step.

According to the coating method just described, in a paint cartridge loading steps, the cylinder of a paint cartridge of a color to be firstly used in a coating operation is set in position on the cartridge mounting portion of the housing of the coating system, with the feed tube of the cartridge place in the feed tube passage. In a next coating step, paint is supplied from the loaded paint cartridge through the feed tube to the rotary atomizing head which is put in high speed rotation by the air motor, thereby spraying the supplied paint on a coating object. Upon finishing a predetermined coating operation with the loaded cartridge, a washing fluid is supplied to the rotary atomizing head from the front side thereof to wash away deposited residues of a previous color from the rotary atomizing head and from fore end portions of the feed tube. Further, upon finishing a washing operation, the used paint cartridge is unloaded from the housing in a paint cartridge unloading step to prepare for a coating operation in a new color.

According to the present invention, there is also provided a coating method by the use of a rotary atomizing head type coating system including: a housing having a coating machine mounting portion on the front side and a cartridge mounting portion on the rear side thereof; a coating machine adapted to be mounted on the coating machine mounting portion of the housing, and having an air motor with a rotational shaft and a rotary atomizing head mounted on a front end portion of the air motor; a feed tube passage hole provided internally of and axially through the rotational shaft of the air motor, and having a front end opened into the rotary atomizing head and a rear end opened into the cartridge mounting portion of the housing; and a plural number of paint cartridges having paint of different colors filled in respective cylinders and a washing cartridge having a washing fluid filled in a cylinder thereof, said paint and washing cartridges having a feed tube extended axially forward from a front end portion of the cylinder; the coating method being characterized by a sequence comprising: a paint cartridge loading step of setting a selected one of the paint cartridges on the coating system, setting the paint cartridge cylinder in position in the cartridge mounting portion of the housing, and placing the feed tube of the paint cartridge in the feed tube passage hole; a coating step of supplying paint in the loaded paint cartridge through the feed tube to the rotary atomizing head being put in high speed rotation; a paint cartridge unloading step of unloading the paint cartridge from the housing after finishing a predetermined coating operation in the coating step; a cleaning cartridge loading step of setting a cleaning cartridge in position in the housing; a washing step of supplying a washing fluid in the cleaning cartridge to the rotary atomizing head through the feed tube; and a cleaning cartridge unloading step of unloading the cleaning cartridge from the housing after finishing washing in the washing step.

According to the coating method just described, in a paint cartridge loading step, the cylinder of a paint cartridge of a color to be used firstly in a coating operation is loaded in position on the cartridge mounting portion of the housing. In a next coating step, paint is supplied from the loaded paint cartridge to the rotary atomizing head which is put in high speed rotation by the air motor to spray the supplied paint on a coating object. Upon finishing a predetermined coating operation in the coating step, the used paint cartridge is unloaded from the housing in a paint cartridge unloading step. In a next cleaning cartridge loading step, a cleaning cartridge is loaded in position on the cartridge mounting portion of the housing to wash away deposited residues of a previous color from the rotary atomizing head. Then, in a washing fluid supplying step, a washing fluid in the cylinder of the cleaning cartridge is supplied to the rotary atomizing head through the feed tube. Upon finishing a washing operation, the used cleaning cartridge is unloaded from the housing to prepare for a next coating operation in a new color.

BEST MODE FOR CARRYING OUT THE INVENTION

Figure 1:
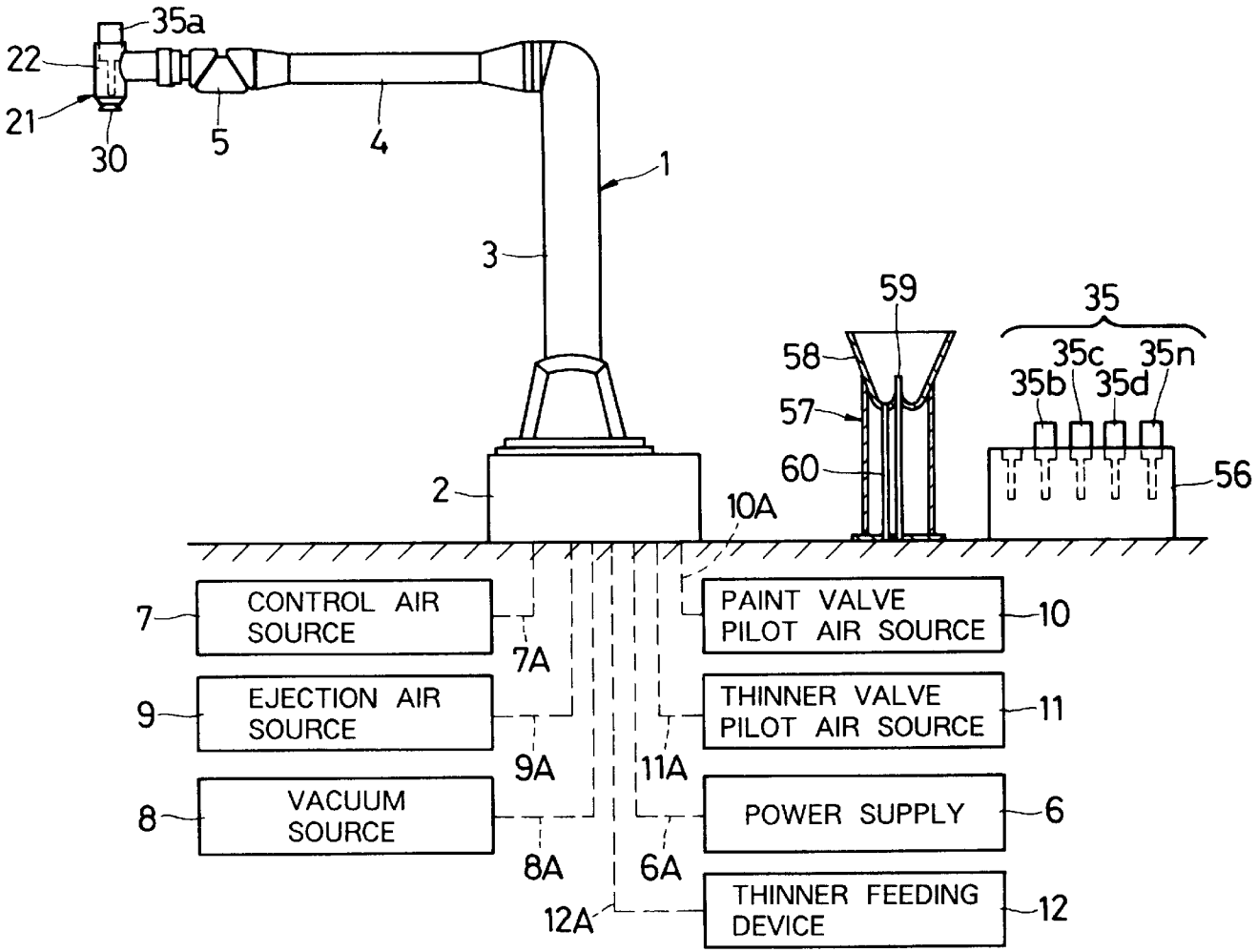
FIG. 1 is a front view of a rotary atomizing head type coating system, adopted as a first embodiment of the present invention and shown together with a coating robot.

Hereafter, with reference to the accompanying drawings, the present invention is described more particularly by way of its preferred embodiments of the rotary atomizing head type coating system, mounted on a coating robot.

Referring first to FIGS. 1 through 10 which show a first embodiment of the present invention, indicated at 1 is a coating robot serving as a working mechanism. The coating robot 1 is largely constituted by a pedestal or base 2, a vertical arm 3 which is rotatably and rockably mounted on the base 1, a horizontal arm 4 which is rockably provided at the fore distal end of the vertical arm 3, and a wrist 5 which is provided at the fore distal end of the horizontal arm 4.

Further, the coating robot 1 has connected thereto various operating fluid means or sources, including a power supply 6 which is connected through a power supply line 6A, a control air source 7 which is connected through an air hose 7A, a vacuum generation source 8 which is connected as a vacuum generating means for a vacuum pump, ejector or the like, through a vacuum hose 8A, an ejection air source 9 which is connected through an air hose 9A, a paint valve pilot air source 10 which is connected through an air hose 10A, a thinner valve pilot air source 11 which is connected through an air hose 11A, and a thinner feeding device 12 which is connected through a thinner hose 12A. The power supply line 6A and the hoses 7A, 8A, 9A, 10A, 11A and 12A are extended as far as the wrist 5 through the vertical and horizontal arms 3 and 4, and connected to the rotary atomizing head type coating system 21 which will be described hereinafter.

Figure 2:
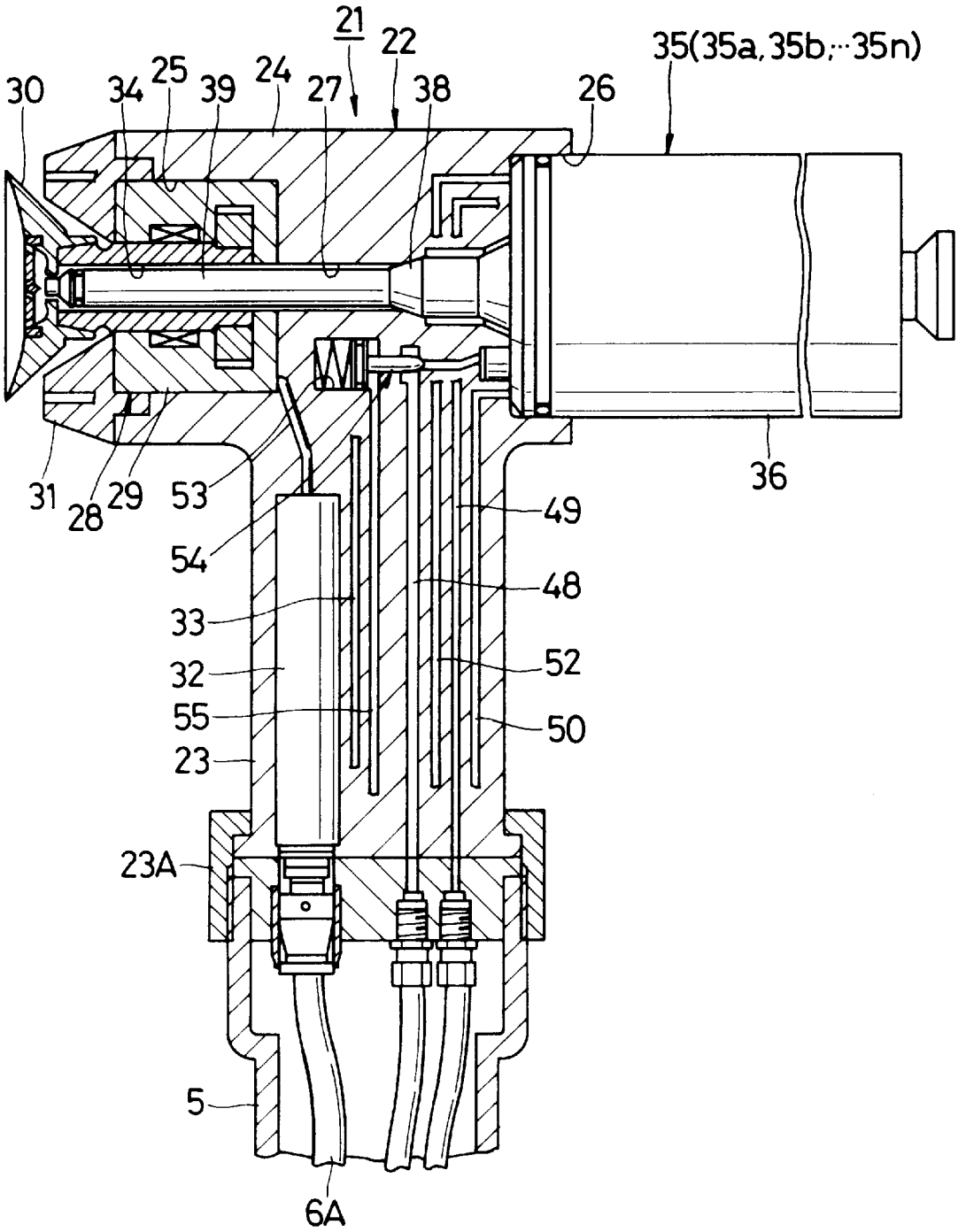
FIG. 2 is a vertical sectional view of the rotary atomizing head type coating system of the first embodiment.
Figure 3:
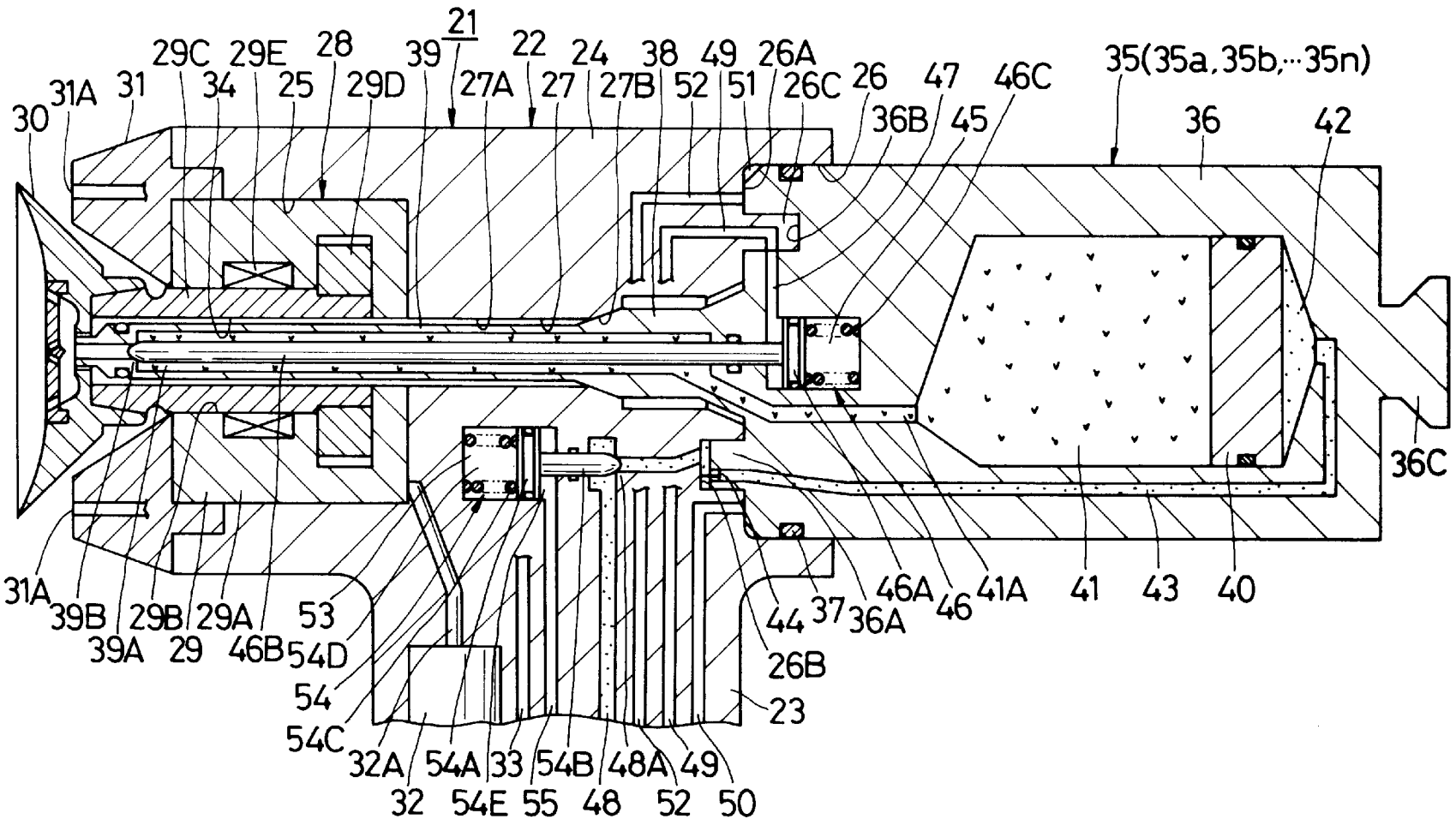
FIG. 3 is a vertical sectional view on an enlarged scale of the rotary atomizing head type coating system shown in FIG. 2.

Indicated at 21 is the rotary atomizing head type coating system (hereinafter referred to simply as "coating system" for brevity) which is mounted on the coating robot 1. As seen in FIGS. 2 and 3, the coating system 21 is largely constituted by a housing 22, a coating machine 28, feed tube passage holes 27 and 34, and a paint cartridge 35.

The housing 22 is formed of an engineering plastic, for example, such as PTFE, PEEK, PEI, POM, PI, PET or the like, and attached to the fore distal end of the wrist 5. The housing 22 is constituted by a neck portion 23 to be detachably fixed to the wrist 5 of the coating robot 1 through a clamp member 23A, and a head portion 24 which is formed at and with the fore distal end of the neck portion 23.

In this instance, a coating machine mount portion 25 and a cartridge mount portion 26, both of a hollow cylindrical shape, are formed on the front and rear sides of the head portion 24, respectively. Further, a female connector portion 26B and a male connector portion 26C are formed separately in a bottom portion 26A of the cartridge mounting portion 26. The female connector portion 26B is engaged with a male connector portion 36A of a cartridge cylinder 36, which will be described hereinafter, while the male connector portion 26C is engaged with a female connector portion 36B of the cylinder 36. The female and male connector portions 26B and 26C of the cartridge mounting portion 26 function as positioning couplers which determine the position of the cartridge cylinder 36 relative to the cartridge mounting portion 26 in the circumferential direction when connected and coupled therewith.

Denoted at 27 is the feed tube passage hole on the side of the housing, which is provided to extend between and in communication with the coating machine mounting portion 25 and the cartridge mounting portion 26 of the housing. The feed tube passage hole 27 on the side of the housing includes a feed tube passage portion 27A of a small diameter which is located on the front side, and a tapered conical recess 27B which is located on the rear side. In this instance, the feed tube passage portion 27A is formed in coaxial relation with a feed tube passage 34 on the side of the coating machine, which will be described hereinafter. The conical recess 27B functions as a positioning coupler to hold the paint cartridge 35 in position in axial and radial directions in cooperation and by fitting engagement with a conical recess 38 on the cartridge 35 as will be described hereinafter.

Indicated at 28 is the coating machine which is fitted in the coating machine mounting portion 25 of the head portion 24. The coating machine 28 is largely constituted by an air motor 29, a rotary atomizing head 30 which is put in rotation by the air motor 29, and a shaping air ring 31 which is provided on the front side of the air motor 29.

In this instance, the air motor 29 is constituted by a motor case 29A to be fitted into the coating machine mounting portion 25, a stepped axial bore 29B which is formed axially through the motor case 29A and varied stepwise in diameter in the axial direction to have a front large diameter portion and a rear small diameter portion, a rotational shaft 29C which is extended axially through the large diameter portion of the axial bore 29B and projected forward of the motor case 29A at its fore end, an air turbine 29D which is securely fixed to the rear end of the rotational shaft 29C, and a static-pressure air bearing 29E which is provided in the motor case 29A and located around the large diameter portion of the axial bore 29B in small gap relation with the rotational shaft 29C.

Figure 4:
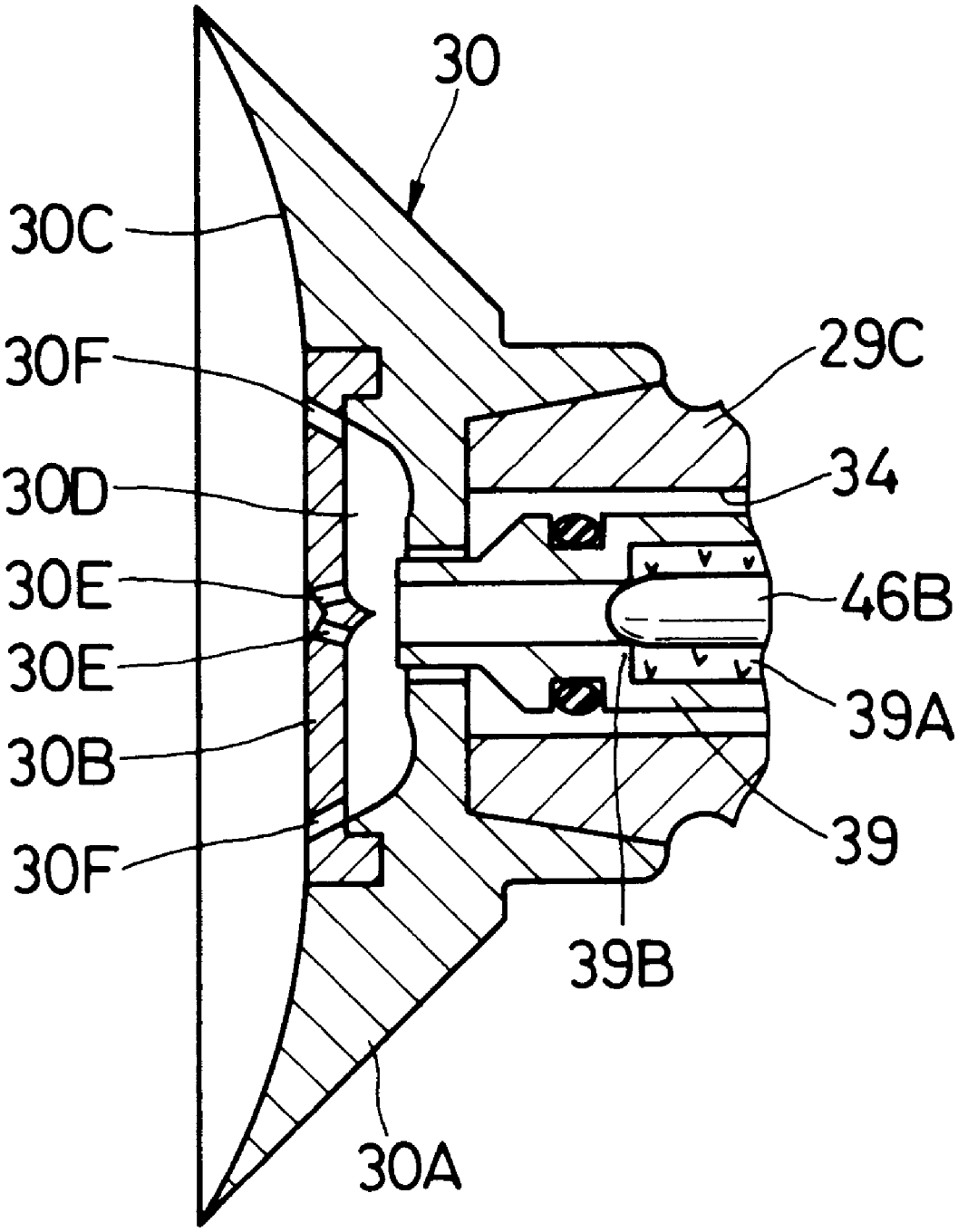
FIG. 4 is a vertical sectional view on an enlarged scale, showing the rotary atomizing head along with fore end portions of rotational shaft and feed tube.

Designated at 30 is the rotary atomizing head which is mounted on the air motor 29 at the fore distal end portion of the rotational shaft 29C. As shown in FIG. 4, the rotary atomizing head 30 is constituted by a bell cup 30A which is formed in a bell-like shape, a hub member 30B of a disk-like shape which is fitted in a center portion on the front side of the bell cup 30A, a paint spreading surface 30C which is formed on the front side of the bell cup 30A radially on the outer side of the hub member 30B for spreading paint into a film, a paint reservoir 30D which is defined on the back side of the hub member 30B, a plural number of washing fluid inlet holes 30E which are provided in center portions on the front side of the hub member 30B to let a washing fluid flow into the paint reservoir 30D from the front side of the hub member 30B, and a large number of paint outlet holes 30F which are provided in outer peripheral portions of the hub member 30B to guide paint, which is supplied thereto from the feed tube 39, toward the paint spreading surface 30C.

The rotary atomizing head 30 is put in high speed rotation by the air motor, whereupon the paint which supplied to the paint reservoir 30D through the feed tube 39 is guided toward the paint spreading surface 30C through the respective paint outlet holes 30F. Then, the paint on the paint spreading surface 30C is spread into a thin film and atomized into fine particles under the influence of centrifugal force. As a result, the atomized paint particles are charged with a high voltage as described hereinafter, and caused to fly toward a coating object 61 to deposit thereon, traveling along an electrostatic field which is formed between the rotary atomizing head and the coating object 61, which will be described hereinafter.

Indicated at 31 is the shaping air ring which is attached to the coating machine mounting portion 25 of the head portion 24 in such a way as to hold the air motor 29 fixedly in position from the front side. The shaping air ring 31 is provided with a large number of shaping air outlet holes 31A annularly on and around the outer peripheral side thereof. Through these shaping air outlet holes 31A, shaping air is spurted out toward paint releasing edges of the rotary atomizing head 30 for shaping charged paint particles into a predetermined spray pattern as soon as they are released from the rotary atomizing head 30.

Denoted at 32 is a high voltage generator which is provided within the neck portion 23 of the housing 22. This high voltage generator 32 is constituted, for example, by a Cockcroft circuit which is arranged to elevate a source voltage, which is supplied from the power supply 6 through the power cable 6A, to a level between −60 kV and −120 kV. Through a high voltage cable 32A, for example, the output side of the high voltage generator 32 is electrically connected to the air motor 29, so that a high voltage is applied to the rotary atomizing head 30 from the high voltage generator 32 through the rotational shaft 29C of the air motor 29 for charging the paint directly. Alternatively, in case sprayed paint particles are to be charged indirectly by means of an external charging system, the output voltage of the high voltage generator 32 is directly supplied to an external electrode which is provided on or in the vicinity of the shaping air ring 31.

Indicated at 33 are a plural number of air passages which are provided in the neck portion 23 of the housing 22 and which are connected to the control air source 7 through the air hose 7A. These air passages 33 supply turbine air, bearing air, brake air and shaping air. In this particular embodiment, one air passage alone is shown to represent the plural number of similar air passages.

In this instance, a turbine air passage supplies air to the air turbine 29D of the air motor 29. A bearing air passage supplies air to the static-pressure air bearing 29E of the air motor 29. A brake air passage supplies braking air to the air turbine 29D to brake its rotation. Further, a shaping air passage supplies air toward the shaping air outlet holes 31A of the shaping air ring 31.

Denoted at 34 is a feed tube passage hole on the side of the coating machine, which is extended axially through the rotational shaft 29C and motor case 29A of the air motor 29. The feed tube passage hole 34 on the side of the coating machine is opened at its rear or base end into a feed tube passage portion 27A of the feed tube passage hole 27 on the side of the housing, and at its front end into the paint reservoir 34D of the rotary atomizing head 30. Further, the feed tube passage hole 34 on the side of the coating machine is formed coaxially aligned relation with the feed tube passage portion 27A of the feed tube passage hole 27 on the side of the housing. A feed tube 39 of a paint cartridge 35 is extractably fitted in these feed tube passage holes 27 and 34.

Figure 5:
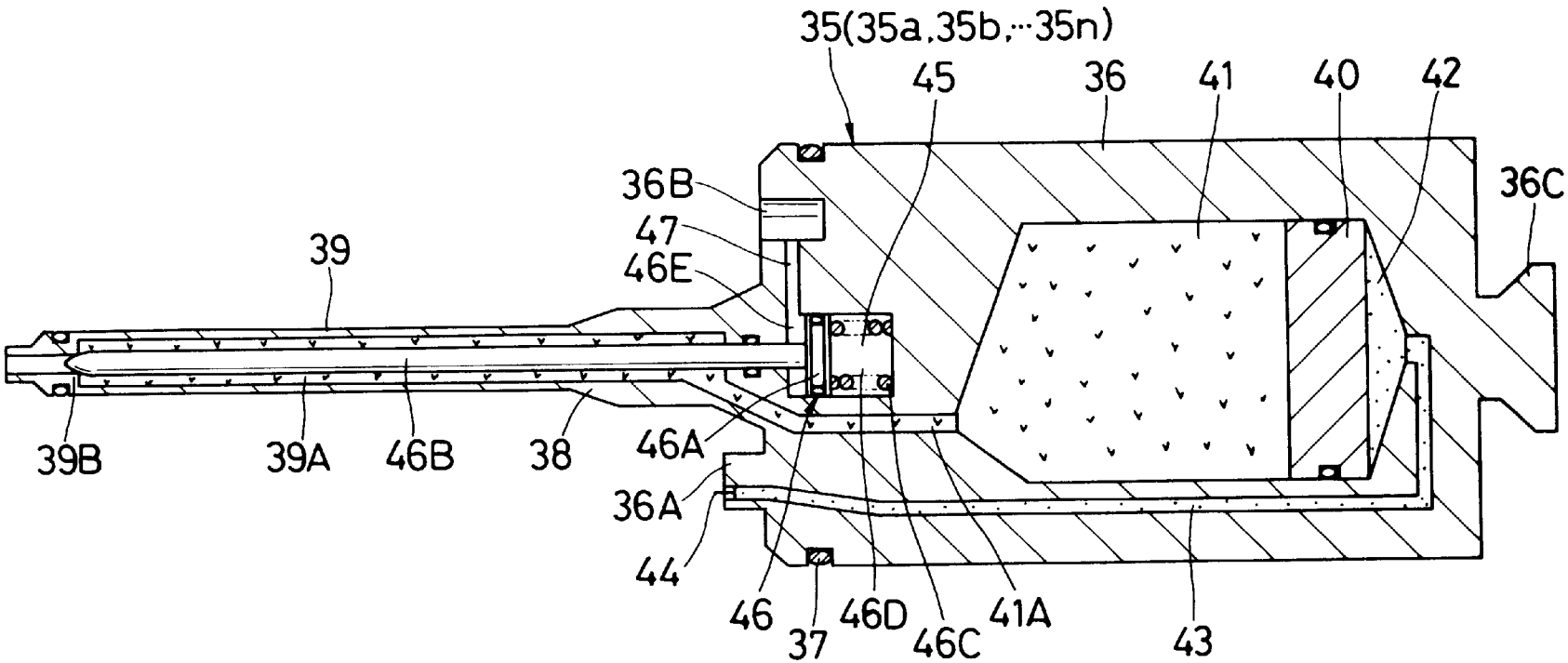
FIG. 5 is a vertical sectional view of a paint cartridge.
Figure 6:
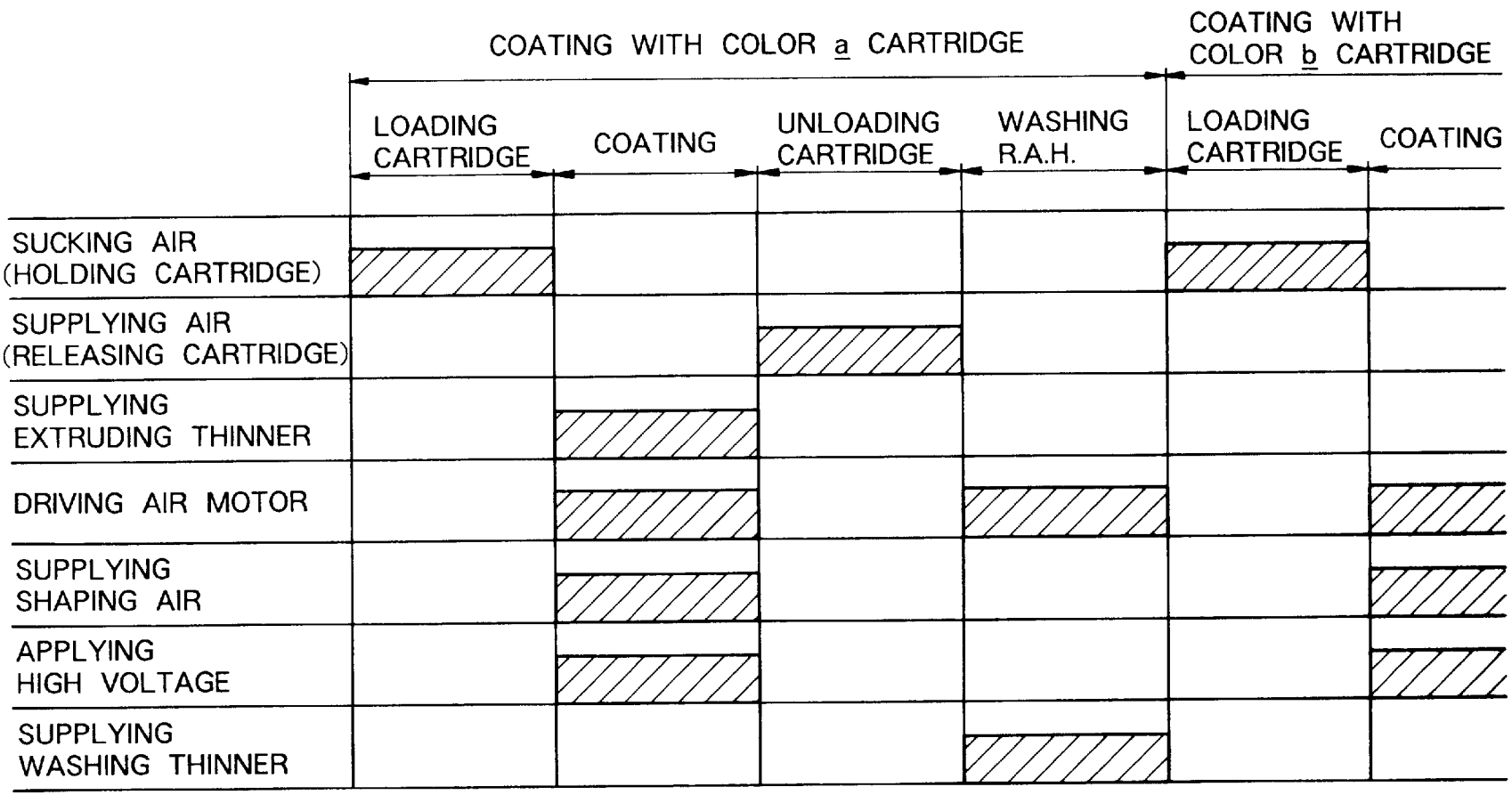
FIG. 6 is an operational time chart of the rotary atomizing head type coating system according to the first embodiment.

Indicated at 35*a,* 35*b* . . . 35*n* are paint cartridges of color a, color b and color n (hereinafter referred to collectively as "paint cartridges 35" for the convenience of explanation), respectively, which hold different paint colors separately and independently for supply to the rotary atomizing head 30. Each one of these paint cartridges 35 is arranged to be inserted into the feed tube passage holes 27 and 34 to supply paint of a particular color independently to the rotary atomizing head 30. As shown in FIG. 5, the cartridges 35 are largely constituted by a cartridge cylinder 36, a conical nose-like projection 38 which is provided on the front end face of the cylinder 36, a feed tube 39 which is extended axially forward from the conical projection 38 to provide therein a paint passage 39A leading from the cartridge cylinder 36, a piston 40 which is fitted in the cartridge cylinder 36 as a movable partition wall, and a thinner passage 43 which is provided on the side of the paint cartridge to supply thinner as a paint extruding liquid.

The cartridge cylinder 36, which is a main body of the paint cartridge 35, is formed of engineering plastic similarly to the housing 22 and in the shape of a cylinder of a suitable diameter which can be detachably fitted in the cartridge mounting portion 26 of the housing. An O-ring 37 is fitted in a fore position on the outer periphery of the cartridge cylinder 36 to hermetically seal the gap space between the cartridge cylinder 36 and the cartridge mounting portion 26. Further, a male connector portion 36A and a female connector portion 36B are provided at the fore end of the cartridge cylinder 36 in confronting positions relative to the female and male connector portion 26B and 26C on the part of the cartridge mounting portion 26, respectively. In addition, the cartridge cylinder 36 is provided with a grip portion 36C at its rear end, which is gripped by an operator when mounting or dismantling the cartridge 35. The male and female connector portions 36A and 36B also function as positioning couplers which determine the position in the circumferential direction of the cartridge cylinder 36 on the cartridge mounting portion 26.

Indicated at 38 is a conical coupling projection which is formed integrally with the cartridge cylinder 36. When the cartridge 35 is mounted on the cartridge mounting portion 26 of the housing 22, the conical projection 38 is coupled with the conical coupling recess 27B, thereby determining the position of the cartridge 35 in both axial and radial directions.

Indicated at 39 is a feed tube which is provided at a fore end of the concial coupling projection 38. A paint supply passage 39A is formed coaxially through the feed tube 39. The base or rear end of the paint supply passage 39A is connected to a paint reservoir chamber 41 which will be described hereinafter, while its fore end is opened toward the rotary atomizing head 30. The feed tube 39 is provided with a valve seat portion 39B which is formed by reducing the diameter of a fore end portion of the paint supply passage 39A. A valve body 46B of a paint valve 46, which will be described hereinafter, is seated on and off the valve seat portion 39B. The feed tube 39 has such a length that its fore distal end is extended into the paint reservoir 30D of the rotary atomizing head 30 when the paint cartridge 35 is mounted on the cartridge mounting portion 26 of the housing 22.

On the other hand, a piston 40 is fitted in the cartridge cylinder 36 for sliding movements in the axial direction. By the piston 40, the cartridge cylinder 36 is partitioned into the paint reservoir chamber 41 which is in communication with the paint supply passage 39A of the feed tube 39 through a communication passage 41A, and a thinner chamber 42 or an extruding liquid chamber which holds thinner therein as an extruding liquid.

Indicated at 43 is a thinner passage on the side of the cartridge. This thinner passage 43 on the side of the cartridge is formed axially in and along the outer periphery of the cylinder 36. One end of the thinner passage 43 is opened in the fore end face of the male connector portion 36A of the cylinder 36, while the other end is communicated with the thinner chamber 42. Through the thinner passage 43 on the side of the cartridge, thinner is supplied to the thinner chamber 42 to push the piston 40 forward in the direction of the feed tube 39. By this forward movement of the piston 40, the paint which is filled in the paint reservoir chamber 41 is extruded toward the rotary atomizing head 30.

The thinner which is used as an extruding liquid is selected from a electrically insulating type or from a high resistance type in order to prevent leaks through the thinner of the high voltage which is applied by the high voltage generator 32. As an extruding liquid, the thinner contributes to keep the inner wall surfaces of the cartridge cylinder 36 constantly in a wet state, preventing the paint from getting dry and sticking as the piston 40 is displaced therealong. Consequently, thanks to stabilization of the frictional resistance in the sliding contact between the piston 40 and the cylinder 36, the piston 40 can be moved very smoothly. In addition, the hermetical seal between the piston 40 and the cartridge cylinder 36 can be improved in tightness.

Indicated at 44 is a valved quick coupling which is provided at the open end of the thinner passage 43 in the male connector portion 36A on the cartridge cylinder 36. The valve of this quick coupling 44 is opened when the cartridge 35 is attached to the cartridge mounting portion 26 with the male connector portion 36A coupled with the female connector portion 26B as shown in FIG. 3, communicating the thinner passage 43 on the side of the cartridge with the thinner passage 48 on the side of the housing to permit a thinner flow therethrough. On the other hand, when the cartridge cylinder 36 is dismantled from the cartridge mounting portion 26, disengaging the male connector portion 36A from the female connector portion 26B as shown in FIG. 5, the thinner passage 43 on the side of the cartridge is closed by the valve spring to prevent thinner from flowing out of the thinner passage 43.

Indicated at 45 is a paint valve receptacle portion which is provided at the front end of the cylinder 36. This paint valve receptacle portion 45 is in the form of a round bore which is located in coaxial relation with the feed tube 39. As described below, a paint valve 46 is accommodated in the paint valve receptacle portion 45.

The paint valve 46, which is provided on the cartridge 45, is opened when the paint in the paint reservoir chamber 41 is to be fed to the rotary atomizing head 30. The paint valve 46 is constituted by a piston 46A which is slidably fitted in the paint valve receptacle portion 45, an elongated valve body 46B which is attached to the piston 46A at its base end and extended through the paint supply passage 39A of the feed tube 39 through the valve receiving bore 45A to seat on and off a valve seat 39B at its fore end, and a valve spring 46C biasing the valve body 46B in the seating direction through the piston 46A. Further, by the piston 46A, the paint valve receptacle portion 45 is divided into a spring chamber 46D which accommodates the above-described valve spring 46C, and a pressure receiving chamber 46E to which pilot air is introduced. Thus, the paint valve 46 is arranged as an air pilot operated control valve.

Normally, the valve body 46B of the paint valve 46 is seated on the valve seat 39B of the feed tube 39 under the influence of the biasing action of the valve spring 46C, shutting off the paint supply passage 39A to stop the paint supply to the rotary atomizing head 30. On the other hand, when pilot air is supplied to the pressure receiving chamber 46E from a paint valve pilot air source 10 through the air hose 10A, pilot air passage 49 on the side of the housing and pilot air passage 47 on the side of the cartridge, the valve body 46B of the paint valve 46 is unseated away from the valve seat 39B against the action of the valve spring 46C to supply paint in the paint reservoir chamber 41 to the rotary atomizing head 30. In this instance, one end of the pilot air passage 47 is opened on the inner periphery of the female connector portion 36B of the cylinder 36, while the other end of the pilot air passage is communicated with the pressure receiving chamber 46E of the paint valve 46.

Indicated at 48 is a thinner passage which is provided on the side of the housing 22. This thinner passage 48 is extended axially through the neck portion 23 and bent rearward in the shape of letter L at the position of a thinner valve receiving portion 53. This thinner passage 48 on the side of the housing has one end connected to a thinner feeding device 12, which quantitatively supplies thinner as an extruding liquid, and has the other end opened on a bottom portion of the female connector portion 26B of the cartridge mounting portion 26. Besides, the bent portion of the thinner passage 48 on the side of the housing forms a valve seat 48A on which a valve body 54B of a thinner valve 54 is to be seated on and off.

Designated at 49 is a pilot air passage which is provided on the side of the housing 22. One end of this pilot air passage 49 is connected to the paint valve pilot air source 10 through the air hose 10A. The other end of the pilot air passage 49 is opened in the circumferential surface of the male connector portion 26C which is provided on the bottom portion 26A of the cartridge mounting portion 26 at a position where it meets the pilot air passage 47 on the side of the cartridge.

Indicated at 50 is an air suction passage which is provided on the housing 22 and opened in the bottom portion 26A of the cartridge mounting portion 26. This air suction passage 50 is connected to a vacuum source 8 through a vacuum hose 8A. The cartridge 35 is drawn to and fixed against the cartridge mounting portion 26 by suction force of the air suction passage which sucks air out of a vacuum space 51 which is defined between the deepest portion of the cartridge mounting portion 26 and the cartridge cylinder 36 of the cartridge 35.

Further, indicated at 52 is an ejection air passage which is provided on the housing 22 and opened in the bottom portion 26A of the cartridge mounting portion 26. This ejection air passage 52 is connected to the ejection air source 9 through the air hose 9A. Upon supplying air to the vacuum space 51 through the ejection air passage 52, the paint cartridge 35 is released from the cartridge mounting portion 26 as a result of cancellation of the vacuum grip, and therefore can be dismantled or unloaded from the housing.

Denoted at 53 is a thinner valve receptacle portion which is provided in the head portion 24 of the housing 22. This thinner valve receptacle portion 53 is in the form of a round bore which is located in a deep position axially spaced from the female connector portion 26B. As described below, a thinner valve 54 is accommodated in the thinner valve receptacle portion 53.

The thinner valve 54 is provided within the length of the thinner passage 48 on the side of the housing, and opened to supply thinner to the thinner chamber 42 at the time of feeding paint in the paint reservoir chamber 41 to the rotary atomizing head 30.

In a manner substantially similar to the paint valve 46, the thinner valve 54 is constituted by a piston 54A which is slidably received in the thinner valve receptacle portion 53, a valve body 54B which is connected to the piston 54A at its base end and projected into the thinner passage 48 to seat on and off a valve seat 48A at its fore end, and a valve spring 54C which constantly biases the valve body 54B in the seating direction through the piston 54A. Further, by the piston 54A, the thinner valve receptacle portion 53 is divided into a spring chamber 54D which accommodates the above-mentioned valve spring 54C, and a pressure receiving chamber 54E into which pilot air is introduced. Thus, the thinner valve 54 is arranged as an air pilot operated control valve.

Normally, under the influence of the biasing action of the valve spring 54C, the valve body 54B of the thinner valve 54 is seated on the valve seat 48A of the thinner passage 48, shutting off the thinner passage 48 to hold thinner supply to the thinner chamber 42. On the other hand, when pilot air is supplied to the pressure receiving chamber 54E from the thinner valve pilot air source 11 through the air hose 11A and pilot air passage 55, the valve body 54B is unseated from the valve seat 48A against the action of the valve spring 54C to permit thinner supply to the thinner chamber 42. In this instance, one end of the pilot air passage 55 is connected to the thinner valve pilot air source 11 through the air hose 11A, while the other end is communicated with the pressure chamber 54E of the thinner valve 54.

On the other hand, indicated at 56 is a cartridge holder table which is provided in a coating booth and in a position in the vicinity of the coating robot 1. Placed on the cartridge holder table 56 are paint cartridges 35*a*, 35*b* . . . 35*n* of different colors. In addition to the paint cartridges, supported on the cartridge holder table 56 are a number of utility equipments (not shown), including a paint refilling device to be used at the time of refilling paint into the paint reservoir chamber 41 of the cartridge 35, and a thinner collecting device to be used for collecting thinner which is discharged from the thinner chamber 42 at the time of refilling paint.

Indicated at 57 is an atomizing head washing device which is fixedly located in the ambience of the coating robot 1 and in the vicinity of the cartridge holder table 56. Provided on top of the atomizing head washing device 57 is a waste liquid collecting container 58 which is open on the upper side. A washing nozzle 59 is projected from beneath into the waste liquid collecting container 58 at a center position, side by side with a waste liquid pipe 60 which collects spent thinner during a cleaning operation. In this instance, (although not shown in the drawings), the washing nozzle 59 is connected to a thinner source through a pump, and the waste liquid pipe 60 is opened into a waste liquid tank.

When the rotary atomizing head 30 of the coating machine 28 is placed in the waste liquid collecting container 58 of the atomizing head washing device 57, thinner is spurted out as a washing fluid through the washing nozzle 59 which is located on the front side of the rotary atomizing head 30 to wash off deposited paint therefrom. Waste liquid resulting from the washing operation on the rotary atomizing head 30 is collected to the above-mentioned waste liquid tank through the waste liquid pipe 60.

With the arrangements described above, the coating system 21 is employed in the present embodiment for a coating method as described below with reference to FIGS. 6 through 10.

Figure 7:
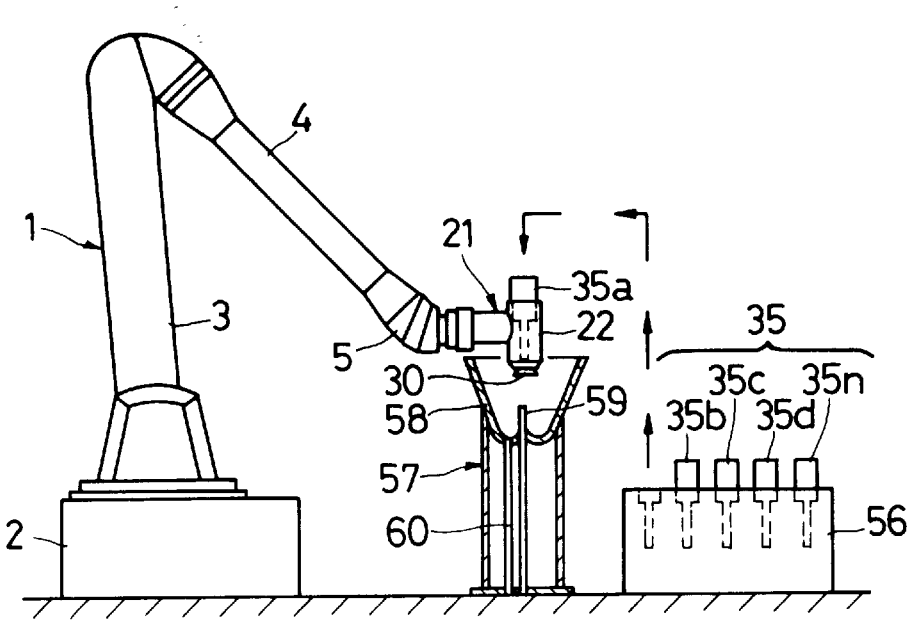
FIG. 7 is a schematic illustration explanatory of an operation by a paint cartridge mounted on the housing of the coating system.
Figure 8:
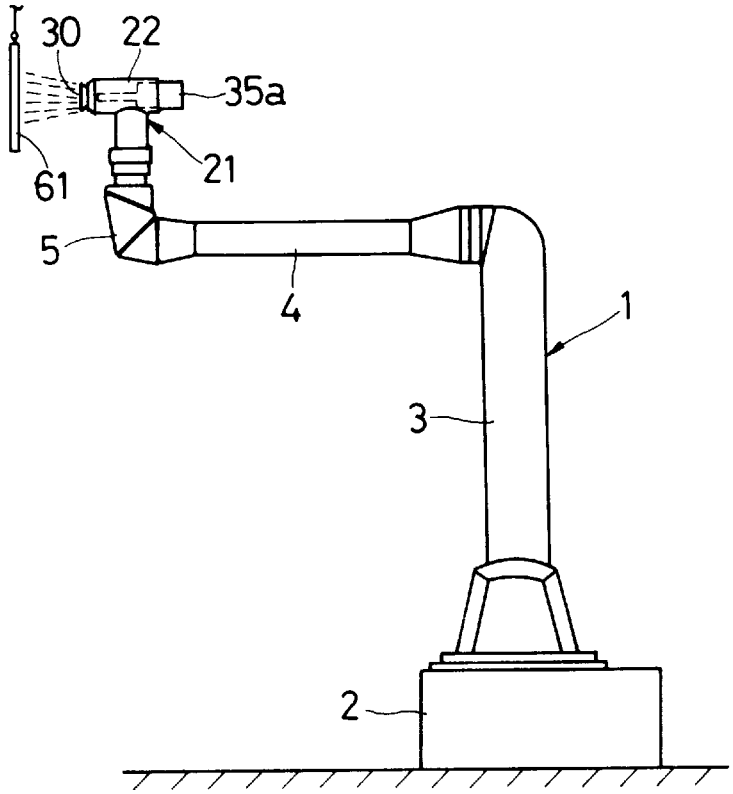
FIG. 8 is a schematic illustration explanatory of a coating operation by the rotary atomizing head type coating system.

Firstly, a piece of work or coating object 61 is coated with paint of the color a by the use of the paint cartridge 35*a* in the manner as follows. In a first cartridge loading step, as shown in FIG. 7, the paint cartridge 35*a* which is filled with paint of color a is picked up from the cartridge holder table 56, and loaded or mounted on the housing 22 of the coating system. When loading the paint cartridge 35*a* on the housing 22, the cartridge cylinder 36 is fitted into the cartridge mounting portion 26 of the head portion 24 while passing the feed tube 39 through the conical recess 27B of the feed tube passage hole 27 on the side of the housing, the feed tube passage portion 27A and feed tube passage hole 34 on the side of the coating machine.

Further, when loading the paint cartridge 35*a*, the vacuum space 51 which is defined between the cartridge mounting portion 26 and the cartridge cylinder 36 is vacuumed through the suction passage 50 to hold the paint cartridge 35*a* fixedly and securely against the housing 22 with suction force, preventing the paint cartridge from falling off the housing.

In a next coating step, the air motor 29 is started to put the rotary atomizing head 30 in high speed rotation, while spurting out shaping air through the respective shaping air outlet holes 31A of the shaping air ring 31 and applying a high voltage to the paint a from the high voltage generator 32. In this state, extruding thinner is quantitatively supplied to the thinner chamber 42 of the cartridge cylinder 36 from the thinner feeding device 12 through the thinner passages 48 and 43. Consequently, as seen from FIG. 8, the paint of the color a in the paint reservoir chamber 41 is supplied to the rotary atomizing head 30 through the feed tube 39, and sprayed toward the coating object 61.

When sprayed, the paint of the color a is centrifugally divided into minute particles and applied with a high voltage on the rotary atomizing head 30 to take the form of charged fine particles. The charged paint particles are shaped into a suitable spray pattern by shaping air which is spurted out through the respective shaping air outlet holes 31A and caused to fly toward and deposit on the coating object 61, traveling along an electrostatic field which is formed between the rotary atomizing head and the coating object 61.

A coating step is succeeded by a cartridge unloading step as follows. In a cartridge unloading step, firstly the coating system 21 is moved to and located in a cartridge unloading position as shown in FIG. 7 by operating the vertical and horizontal arms 3 and 4 of the coating robot 1. More specifically, the front side of the coating machine 28 is put in the waste liquid collecting container 58 in face to face relation with the washing nozzle 59. In this state, air is supplied to the vacuum space 51 through the ejection air passage 52 to cancel the suction grip which has been holding the paint cartridge 35a fixedly against the cartridge mounting portion 26. Then, as indicated by arrows in FIG. 9, the paint cartridge 35*a* is gripped by a gripper 62 and axially extracted out of the housing 22 and returned to the cartridge holder table 56.

Figure 9:
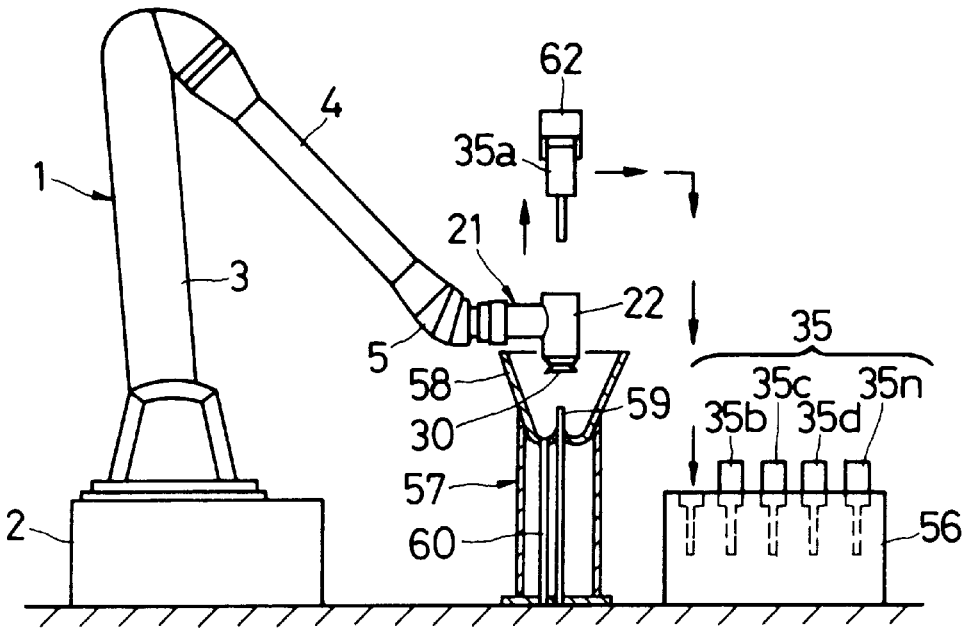
FIG. 9 is a schematic illustration explanatory of an operation of unloading the paint cartridge over an atomizing head washing device.
Figure 10:
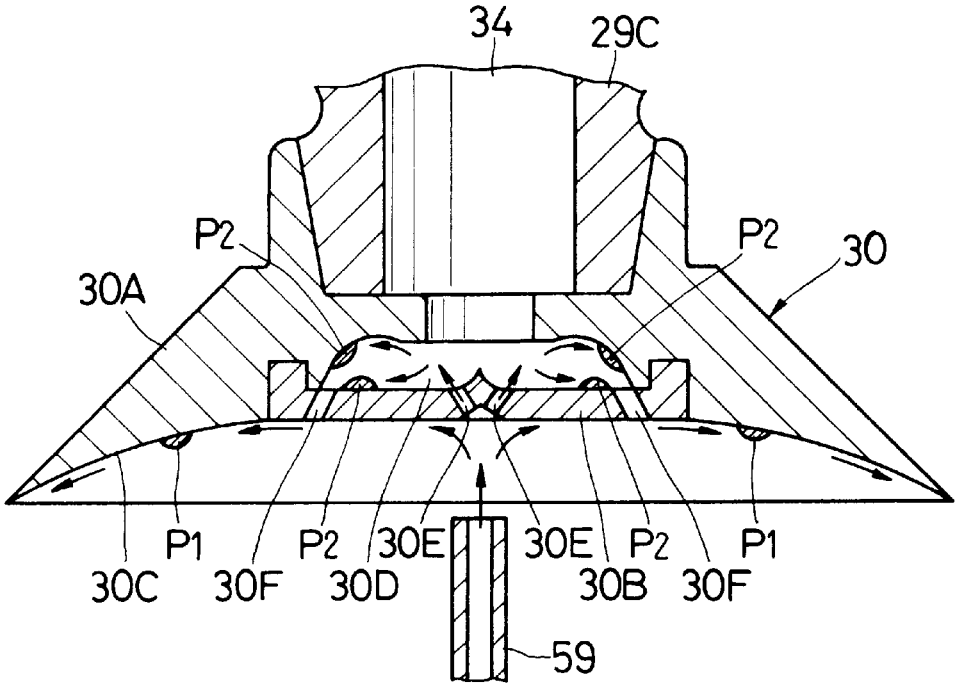
FIG. 10 is a schematic illustration, showing on an enlarged scale the manner in which the rotary atomizing head is cleaned by the atomizing head washing device.
Figure 11:
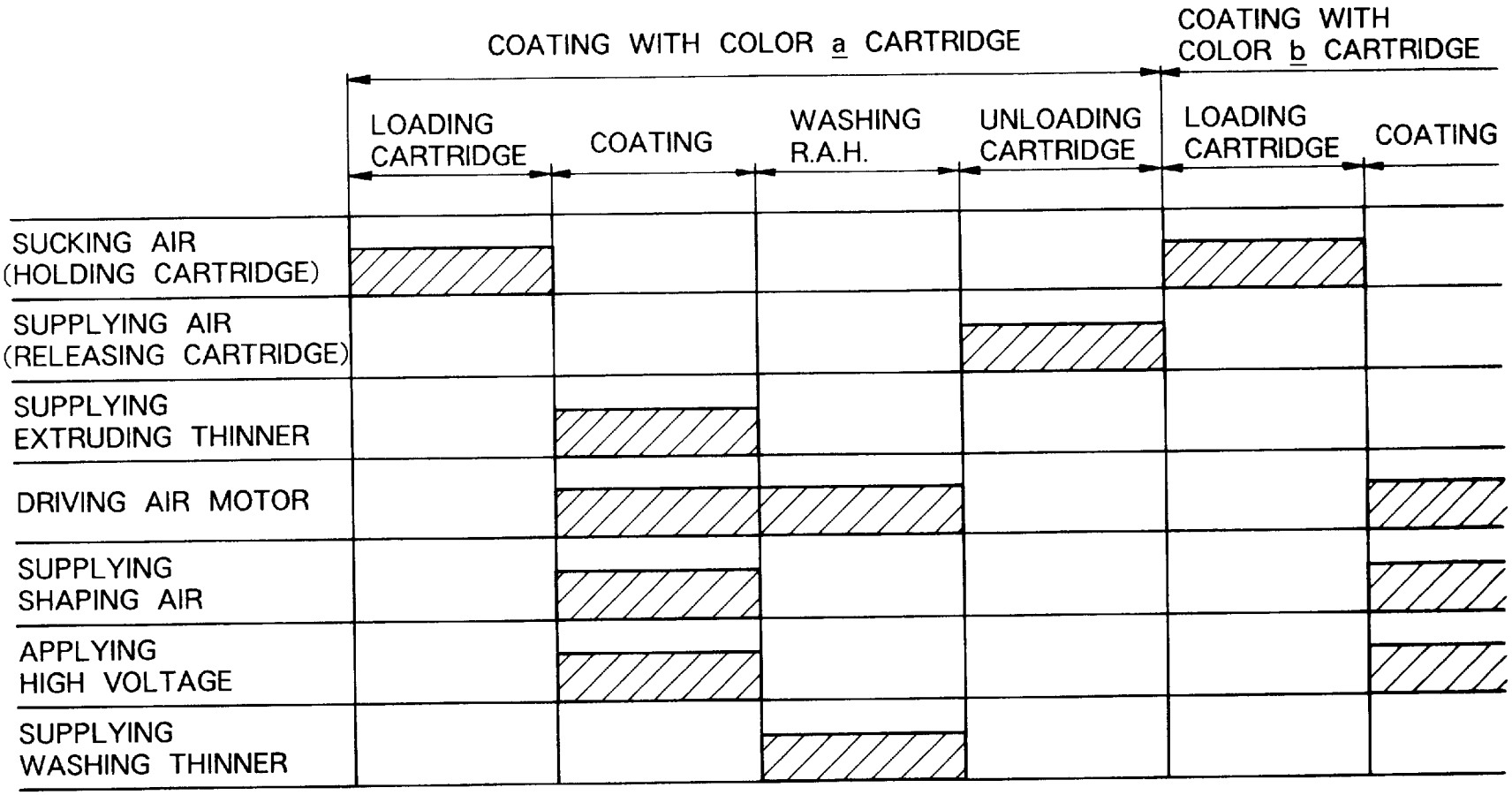
FIG. 11 is an operational time chart of a rotary atomizing head type coating system according to a second embodiment of the invention.
Figure 12:
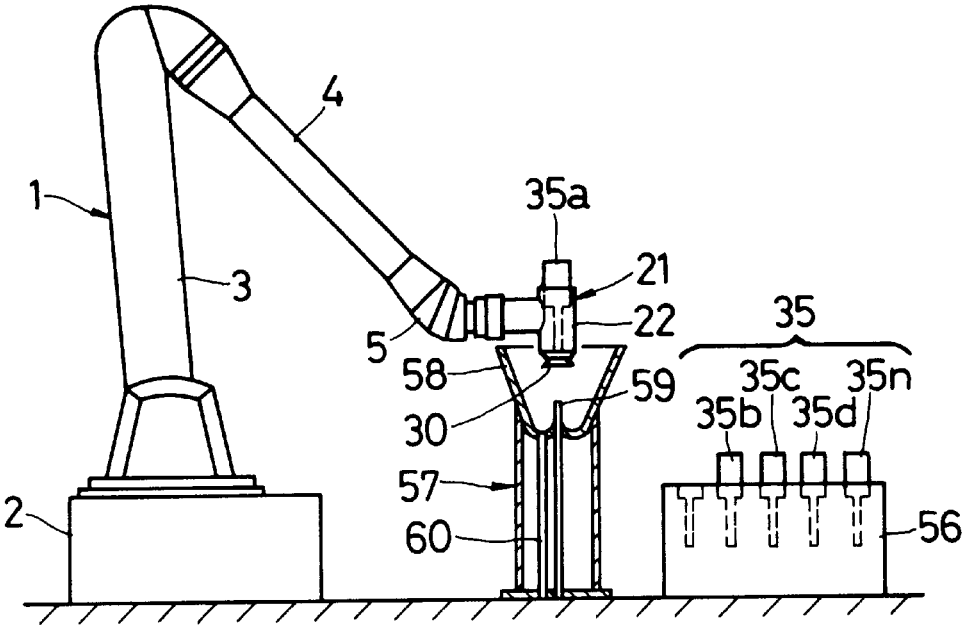
FIG. 12 is a schematic illustration of the rotary atomizing head type coating system which is located in a cartridge replacing position.

Succeeding to the cartridge unloading step is an atomizing head washing step as follows. In this step, the coating robot 1 is operated to hold the front side of the coating machine 28 in the atomizing head washing device 57 as shown in FIG. 9. Besides, the rotary atomizing head 30 is put in high speed rotation by the air motor 29. In this state, as shown in FIG. 10, washing thinner is spurted out from the washing nozzle 59 toward the front side of the rotary atomizing head 30.

Under the influence of centrifugal force, the washing thinner which is supplied to the front surface of the hub member 30B is caused to flow from the center toward the paint spreading surface 30C of the bell cup 30A to wash away paint residues P1 from the paint spreading surface 30C. On the other hand, the washing thinner which is allowed to enter the paint reservoir 30D through washing fluid inlet holes 30E of the hub member 30B flows along inner wall surfaces of the paint reservoir 30D and the back side of the hub member 30B to wash away paint residues P2 therewith as it flows out through paint outlet holes 30F. The spent thinner resulting from the washing operation is caught in the waste liquid collecting container 58 and collected into a waste liquid tank through the waste liquid pipe which is connected to the container 58.

Upon finishing in this manner a coating operation with the paint cartridge 35*a* of the color a, for example, the paint cartridge 35*b* of color b is picked up from the cartridge holder table 56 and loaded on the housing 22 to carry out a coating operation in color b in a manner similar to the above-described coating operation in color a.

Thus, according to the present embodiment, the housing 22 of the coating machine is mounted on the wrist 5 of the coating robot 1, while paint cartridges 35*a,* 35*b* . . . 35*n* which are filled with paint of different colors a, b, . . . n are placed in predetermined positions. After this preparatory step, a cycle of coating operation is started for the coating object 61, with a cartridge loading step in which the paint cartridge 35 is loaded into the housing 22 of the machine, followed by a coating step in which the paint is supplied from the cartridge 35 to the rotary atomizing head 30 and sprayed on the coating object 61, a cartridge unloading step in which the paint cartridge 35 is unleaded from the housing 22, and a washing step in which the rotary atomizing head 30 is washed to removed deposited paint residues therefrom.

Thus, according to the present embodiment, the provision of a plural number of paint cartridges of different colors makes it possible to cope with multiple color changes by the use of a single coating system 21 in a reliable manner and to broaden the range of application of the coating system. Besides, other paint colors can be added simply by providing a corresponding number of paint cartridges 35, without necessitating to reconstruct the coating system 21.

In addition, since the coating system 21 employs a plural number of paint cartridges 35 of different colors replaceably and interchangeably, it can reduce the amount of paint to be discharged or discarded at the time of a color change and contribute to shorten the washing time, minimizing the amounts of waste paint and thinner to a level which is friendly to the environment.

Further, the omission of a paint feed hose from the coating system precludes the possibilities of high voltage leaks even in the case of a metallic paint or a water base paint of low electrical resistance. It follows that the coating system 21 can find a wide range of applications involving various kinds of paint.

Further, the atomizing head washing device 57 for cleaning the rotary atomizing head 30 is provided separately from the coating system 21. This can preclude leaks of high voltage through thinner or other washing fluid, and permits to simplify a high voltage shielding (voltage block) structure.

Moreover, the coating system 21 is provided with the paint valve 46 which turns on and off the paint supply, along with the thinner valve 54 which turns on and off the supply of extruding thinner. Therefore, as the paint and thinner valves 46 and 54 are opened and closed in response to spray-on and spray-off command signals, the paint spray can be started and stopped immediately on these command signals.

Accordingly, in a coating operation, the coating system can control on-off of the paint spray according to a programmed routine with higher reliability, forming coatings which are improved in quality, particularly, uniform in thickness. Besides, at the time of extracting the paint cartridge 35 out of the housing 22 for replacement, there is no possibility of the paint dripping down from the feed tube 39.

Referring now to FIGS. 11 to 14, there is shown a second embodiment of the coating method according to the present invention, which has a feature in that a washing step is carried out before unloading a paint cartridge. In the following description of the second embodiment, those component parts which are common with the foregoing first embodiment are simply designated by common reference numerals or characters to avoid repetition of same explanations.

More particularly, described below is a case in which a coating object or a piece of work 61 is coated with paint of color a by the use of the paint cartridge 35*a*. In a cartridge loading step, the paint cartridge 35*a* which is filled with paint of the color a is picked up from the paint cartridge holder table 56 and loaded into the housing 22 in the same manner as in the foregoing first embodiment. At this time, air is sucked out of the vacuum space 51 through the air suction passage 50 to hold the paint cartridge 35*a* fixedly to the housing 22 with suction force.

In the next coating step, the rotary atomizing head 30 is put in high speed rotation by the air motor 29, while at the same time shaping air is spurted out through the respective shaping air outlet holes 31A and a high voltage is applied to the paint of color a from the high voltage generator 32. Then, in this state, paint-extruding thinner is quantitatively supplied to the thinner chamber 42, thereby pushing the piston 40 forward to feed the paint of color a in the paint reservoir chamber 41 toward the rotary atomizing head 30 to start spraying the paint a on the coating object 61.

Figure 13:
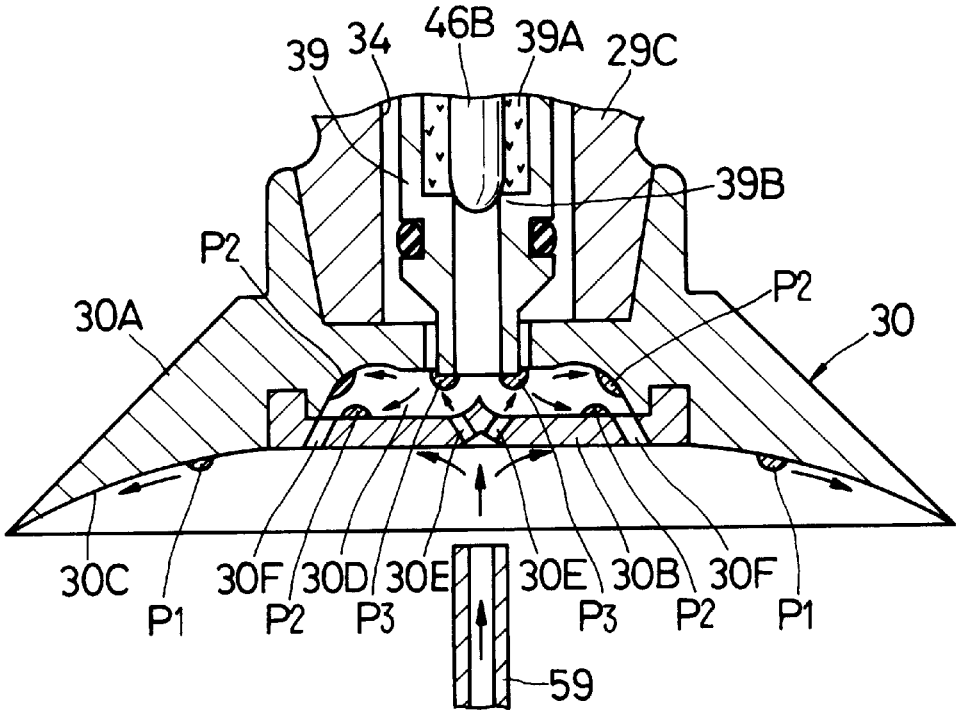
FIG. 13 is a schematic illustration, showing on an enlarged scale the manner in which the rotary atomizing head is cleaned by the atomizing head washing device along with fore end portions of a feed tube.

The coating step is followed by a washing step. For this purpose, the vertical and horizontal arms 3 and 4 of the coating robot 1 are operated to move and locate the coating system 21 in the cartridge replacing position shown in FIG. 12. In this state, as shown in FIG. 13 thinner is spurted out through the washing nozzle 59 and supplied toward the front side of the rotary atomizing head 30 which is put in high speed rotation by the air motor 29.

As a result, in the washing step, the thinner flow on the front surface of the hub member 30B is directed from the center toward the paint spreading surface 30C of the bell cup 30A under the influence of centrifugal force to wash away deposited paint residues P1 from the paint spreading surface 30C. Besides, along with thinner which has entered the paint reservoir 30D through the washing fluid inlet holes 30E of the hub member 30B, deposited paint residues P2 on the inner surfaces of the paint reservoir 30D and on the back side of the hub member 30B are washed away. Further, paint residues P3 on a fore end portion of the feed tube 39 are washed away with part of the thinner which has entered the paint reservoir 30D. After washing various parts in this manner, the thinner which flows out through the paint outlet holes 30F is collected into the waste liquid collecting container 58.

Figure 14:
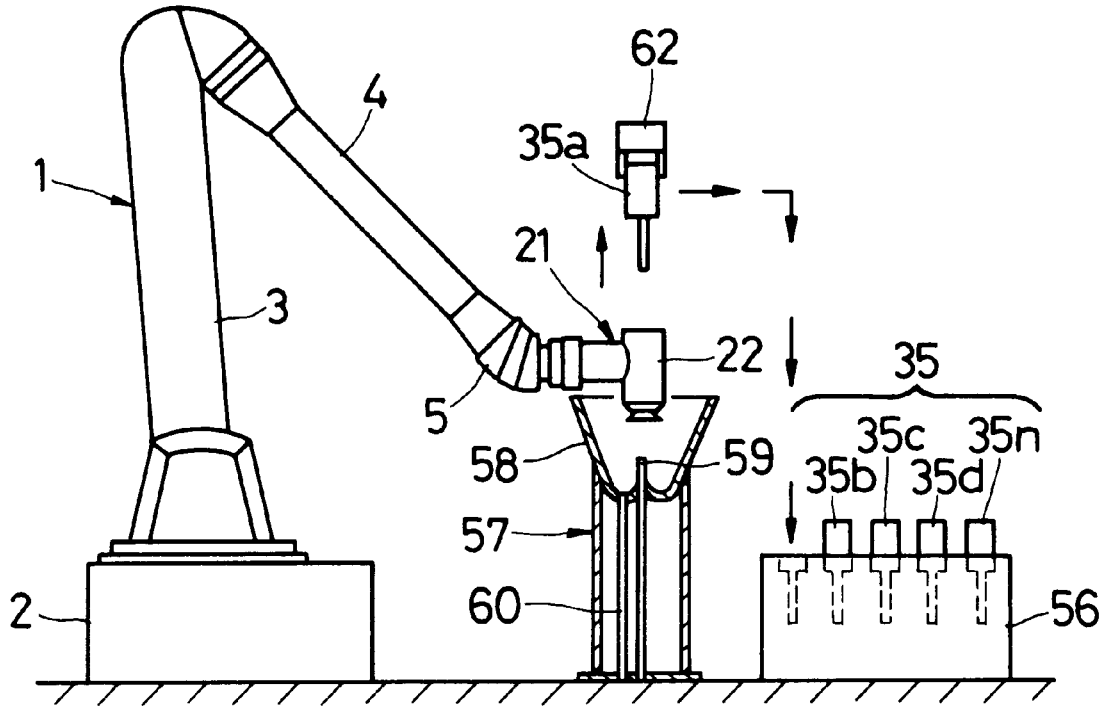
FIG. 14 is a schematic illustration explanatory of an operation of unloading a paint cartridge from the housing of the coating system.

In a next cartridge unloading step, the cartridge 35a released from the cartridge mounting portion 26 by cancellation of the suction grip, and as seen from the FIG. 14, gripped in a gripper member 62 and axially extracted from the housing 22 and returned to the cartridge holder table 56.

Thus, the present embodiment, with the arrangements just described, can produce substantially the same operational effects as in the foregoing first embodiment. In this particular embodiment, however, the rotary atomizing head is cleaned in a washing step immediately after a coating step, namely, prior to a cartridge unloading step. Therefore, fore end portions of the feed tube 39 of the cartridge 35 can be washed clean simultaneously at the time of washing the rotary atomizing head 30. Thus, clogging of the feed tube 39 can be prevented because residues of a previous color are washed away from fore end portions of the feed tube before unloading the paint cartridge 35 from the rotary atomizing head 30.

Figure 15:
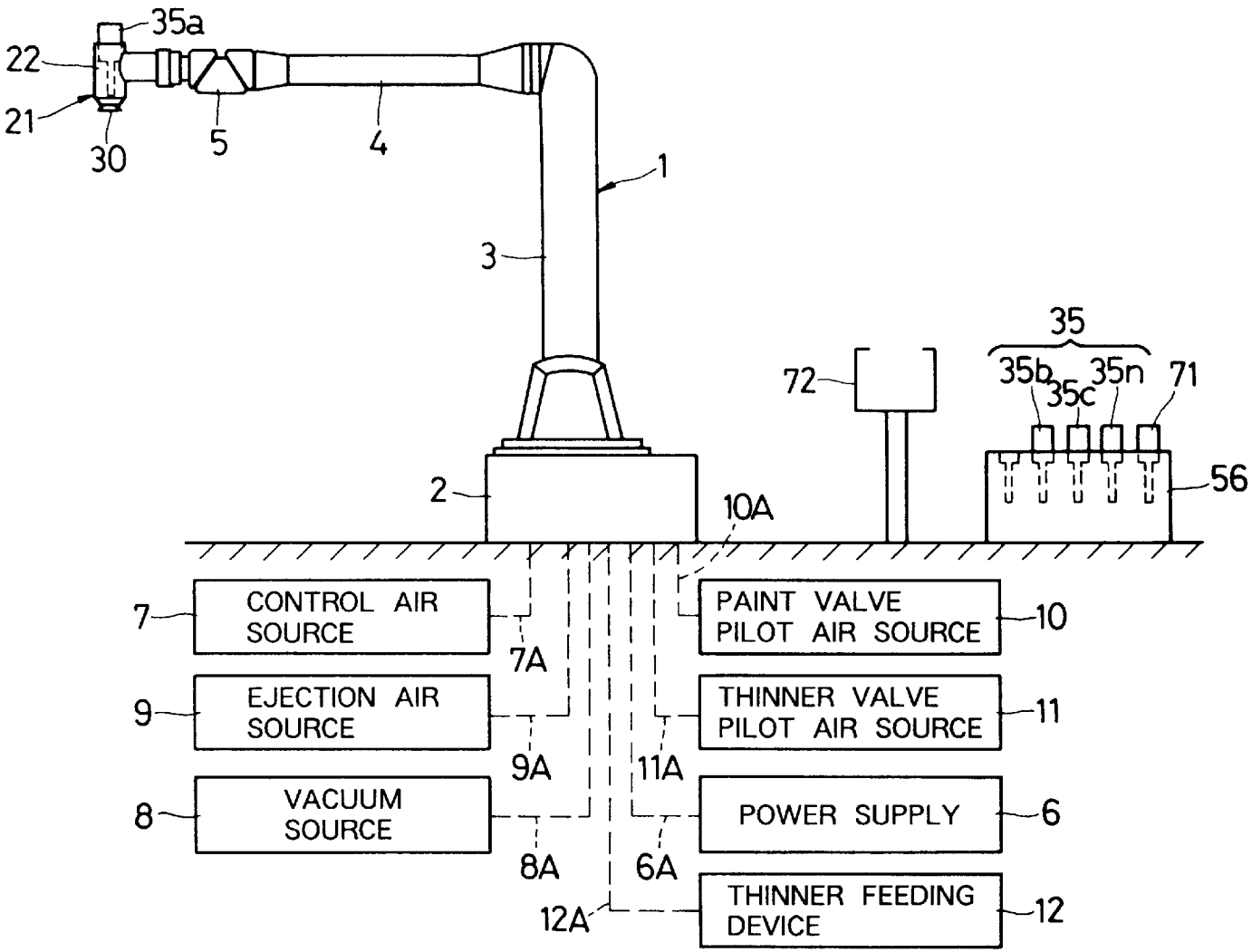
FIG. 15 is a front view of a rotary atomizing head type coating system and a coating robot according to a third embodiment of the present invention.
Figure 16:
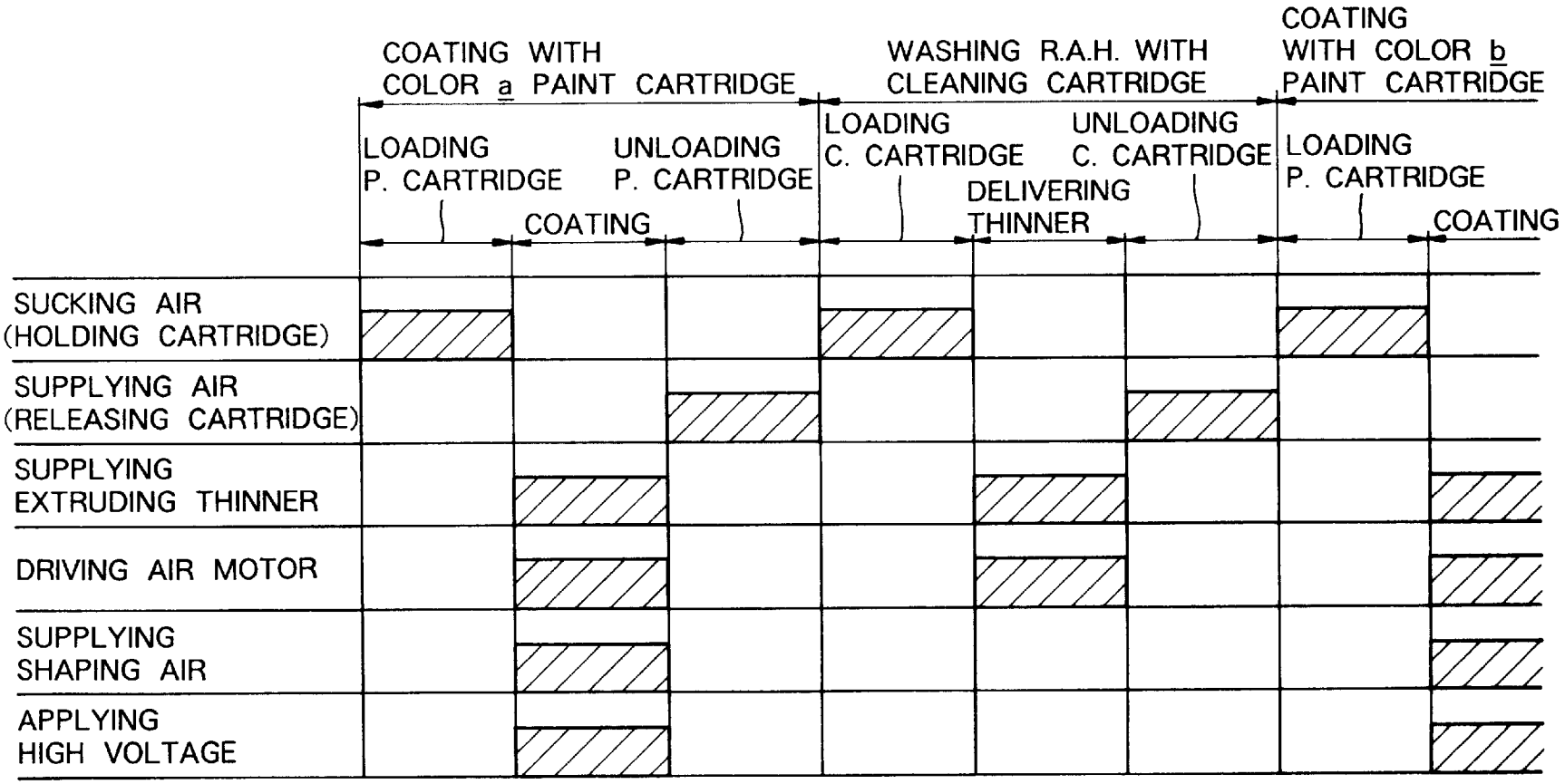
FIG. 16 is an operational time chart of the rotary atomizing head type coating system according to the third embodiment.
Figure 17:
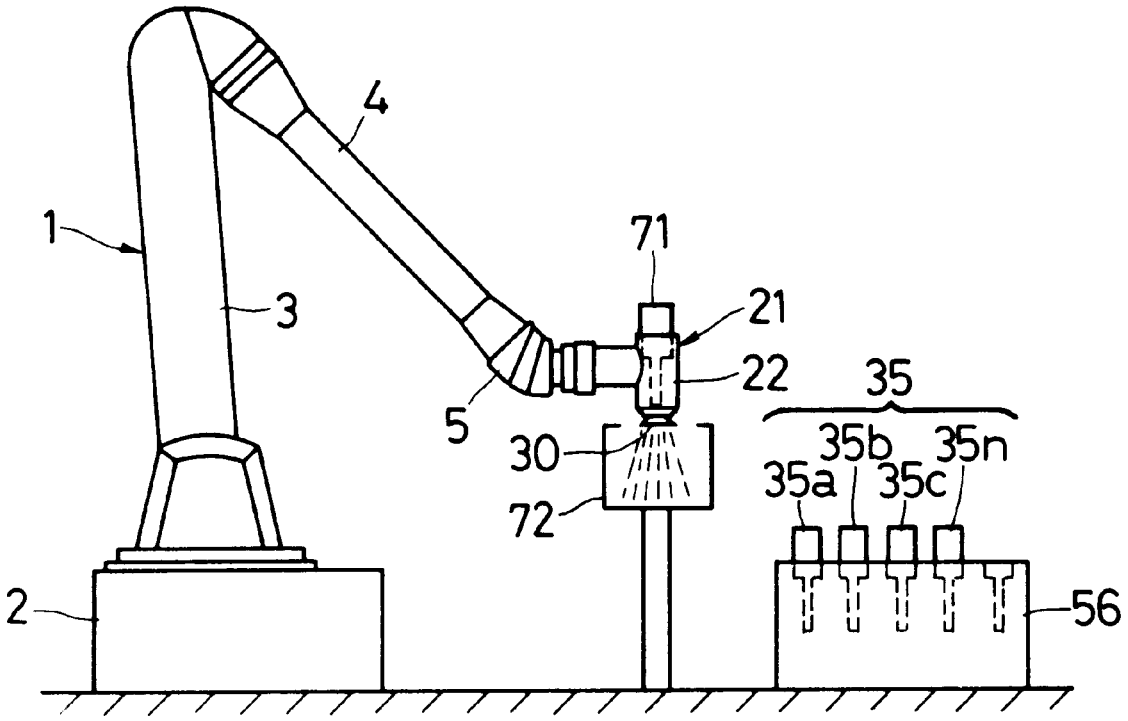
FIG. 17 is a schematic illustration, showing the manner in which the rotary atomizing head is cleaned by means of a cleaning cartridge.

Shown in FIGS. 15 to 17 is a third embodiment of the present invention, with a feature in that the rotary atomizing head is washed clean by the use of a cleaning cartridge which is filled with a washing fluid. In the following description of the third embodiment, those component parts which are common with the foregoing first embodiment are simply designated by common reference numerals or characters to avoid repetition of same explanations.

In these figures, indicated at 71 is a cleaning cartridge which is employed in the present embodiment. For setting on the cartridge mounting portion 26 of the housing 22, the cleaning cartridge 71 is configured similarly to the paint cartridge 35. However, the cleaning cartridge 71 is filled with thinner which serves as a washing fluid. Along with the paint cartridges 35, the cleaning cartridge 71 is placed on the cartridge holder table 56.

Indicated at 72 is a waste liquid collecting container which is located within the coating booth in the vicinity of the coating robot 1 for collecting spent thinner. The waste liquid collecting container 72 is connected to a waste liquid tank (not shown), but not provided with a washing nozzle as described hereinbefore in connection with the rotary atomizing head 57 of the first embodiment.

FIG. 16 shows a coating method by the use of a coating system 21 according to the present embodiment as described above.

Firstly, described below by way of example is a coating operation in which a coating object or a piece of work 61 is coated with the paint of color a by the use of the paint cartridge 35*a* in the manner as follows. In the cartridge loading step, the paint cartridge 35*a* which is filled with paint of color a is loaded on the housing 22 in the same manner as in the above-described first embodiment, and fixed to the housing 22 by sucking air out of the vacuum space 51 through the air suction passage 50.

In the next coating step, the rotary atomizing head 30 is put in high speed rotation by the air motor 29, while shaping air is spurted out through the respective shaping air outlet holes 31A and a high voltage is applied to the paint of color a from the high voltage generator 32. In this state, paint-extruding thinner is quantitatively fed to the thinner chamber 42, pushing the piston 40 forward to supply the paint of color a from the paint reservoir chamber 41 to the rotary atomizing head 30 to spray same on the coating object 61.

In a next cartridge unloading step, air is supplied to the vacuum space 51 through the ejection air passage 52 to cancel the suction grip, and then the paint cartridge 35*a* is unloaded from the housing 22.

The unloading step is followed by a washing step for cleaning the rotary atomizing head 30. In this washing step, the rotary atomizing head 30 is washed by the use of the cleaning cartridge 71 by a washing operation which consists of three phases, i.e., a cleaning cartridge loading phase, a thinner discharging phase and a cleaning cartridge unloading phase.

In the cleaning cartridge loading phase, firstly the cleaning cartridge 71 is set on the cartridge mounting portion 26 of the housing 22. At this time, air is sucked to hold the cleaning cartridge 71 fixedly to the housing 22 with suction force.

In the thinner discharging phase or washing fluid delivering phase, as shown in FIG. 17, the rotary atomizing head 30 of the coating machine 28 is placed in the waste liquid collecting container 72 by operating the vertical and horizontal arms 3 and 4 of the coating robot 1. In this state, the rotary atomizing head 30 is put in high speed rotation by the air motor 29, while extruding thinner is supplied to the cleaning cartridge 71 to spout wash thinner in the cleaning cartridge 71 toward the rotary atomizing head 30, thereby washing away deposited paint residues of color a from the rotary atomizing head 30.

In the next cleaning cartridge unloading phase, after canceling the suction grip, the cleaning cartridge 71 is unloaded from the housing 22 to end a washing operation on the rotary atomizing head 30.

The present embodiment, with the arrangements just described, can produce substantially the same operational effects as the foregoing embodiments. Especially in this case, a cartridge which is of the same construction as the paint cartridge 35 can be used as the cleaning cartridge 71, so that the rotary atomizing head 30 can be washed by equipments of simple construction and of lower cost.

In the foregoing embodiments, the coating system 21 is shown as being mounted on the wrist 5 of the coating robot 1. However, the present invention is not limited to this particular form shown. For example, if desired, the coating system 21 may be mounted on a working mechanism such as a reciprocator or the like. In such a case, since a reciprocator usually has a limited movable range, it is desirable that the atomizing head washing device 57 and the waste liquid collecting container 72 are arranged to be movable.

Further, the cartridges 35 and 71 in the foregoing embodiments are provided with the piston 40, thereby extruding paint or thinner. However, in place of the piston 40, there may be employed a bellows tube which is filled with paint and arranged to extrude paint as it is pushed into a contracted from.

Figure 18:
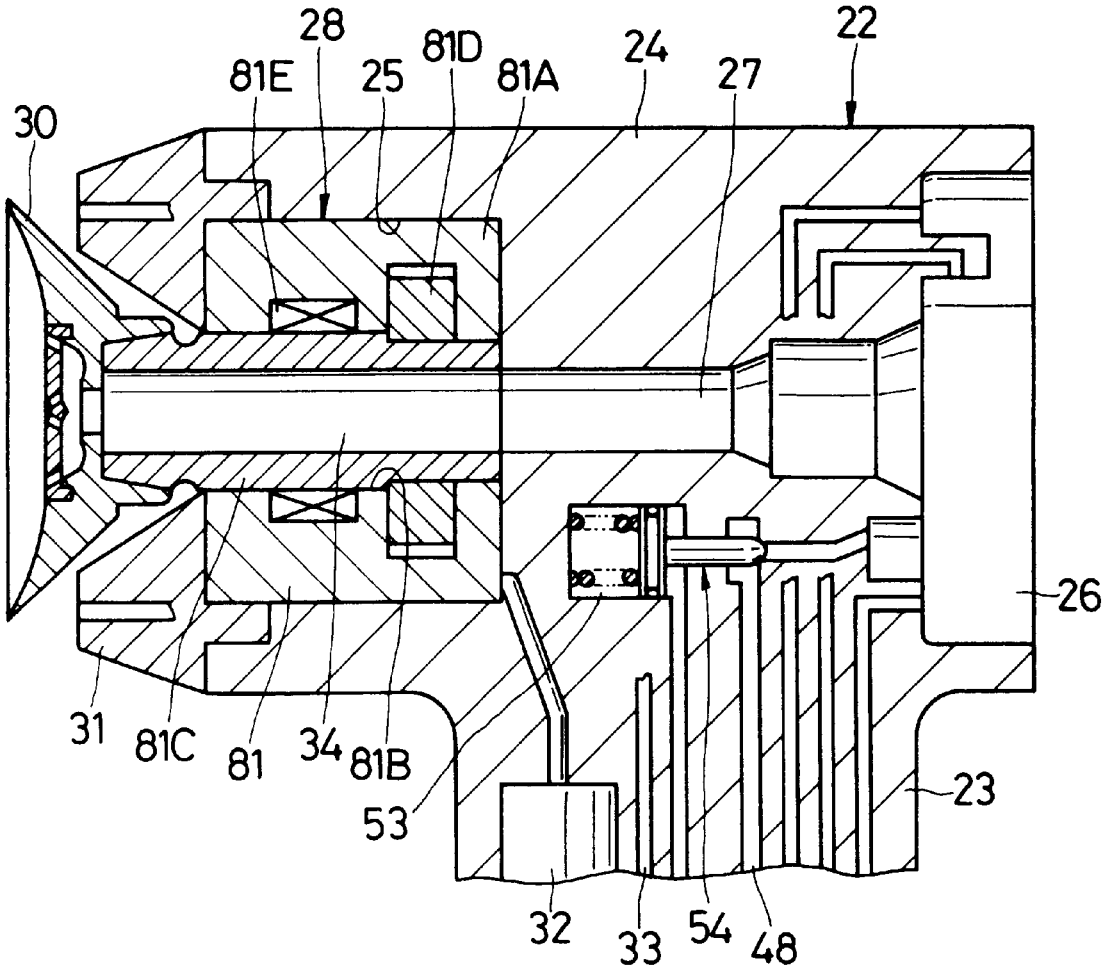
FIG. 18 is a vertical sectional view of a modification of the coating system of the present invention.

Further, in the foregoing embodiments, the axial bore 29B of the air motor 29 is shown as being formed in a stepped form including a rear small-diameter portion and a front large-diameter portion, and the rotational shaft 29C is received in the large-diameter portion of the axial bore 29B. However, it is to be understood that the present invention is not limited to this particular form. For example, as shown in the modification of FIG. 18, there may be employed an air motor 81 which has a rotational shaft 81C extended through an axial bore 81B which has almost a uniform diameter in the axial direction.

Further, in the foregoing embodiments, air is sucked out of the vacuum space 51 through the air suction passage 50 to hold the cartridge 35 or 71 fixedly against the housing 22 by a suction grip. However, the present invention is not limited to this arrangement. For example, the cartridge 35 or 71 may be fixed in position by means of a lock member which is provided on the side of the housing 22 and adapted to engage with a locking hole which is provided on the side of the cartridges 35 and 37.

Further, although thinner is used as an extruding liquid by way of example in the foregoing embodiments, water or other extruding liquid may be applied depending upon the type of paint or high voltage application system to be used.

Industrial Applicability

As clear from the foregoing particular description, according to the present invention, a washing fluid is supplied to the front side of a rotary atomizing head after finishing a coating operation by the use of a paint cartridge, washing away deposited paint residues of a previous color from the rotary atomizing head to prepare for a coating operation in a new color.

Accordingly, by providing a plural number of paint cartridges which are filled with paint of different colors or types, it becomes possible to make multiple color changes in the course of a coating operation by a single rotary atomizing head type coating system, enhancing the reliability in operation and broadening the range of application of the coating system. Besides, since the paint cartridge is not connected to any paint supply hose or the like, it becomes possible to prevent leaks of high voltage through paint even in a coating operation using a paint of low electrical resistance like metallic paint and water base paint, making the coating system operative with a diversity of paint and as a result enhancing its reliability.

Further, the rotary atomizing head can be washed from front side while a cartridge is still mounted on the housing of the coating system, so that deposited paint residues can be washed away from the feed tube of the cartridge simultaneously with the washing of the rotary atomizing head, preventing clogging of the feed tube.

Moreover, by providing a cleaning cartridge which is filled with a washing fluid, along with a plural number of paint cartridges of diversified colors, it becomes possible to make color changes at multiple points in the course of a coating operation in a facilitated and economical manner.

What is claimed is:

1. A coating method by the use of a rotary atomizing head type coating system including: a housing having a coating machine mounting portion on the front side and a cartridge mounting portion on the rear side thereof; a coating machine adapted to be mounted on said coating machine mounting portion of said housing, and having an air motor with a rotational shaft and a rotary atomizing head mounted on a front end portion of said air motor; a feed tube passage hole provided internally of and axially through said rotational shaft of said air motor, and having a front end opened into said rotary atomizing head and a rear end opened into said cartridge mounting portion of said housing; and a plural number of paint cartridges having paint of different colors filled in respective cylinders, and having a feed tube extended axially forward from a front end portion of said cylinder; characterized in that said coating method comprises:

a paint cartridge loading step of loading a selected one of said paint cartridges, setting said paint cartridge cylinder in position in said cartridge mounting portion of said housing, and placing said feed tube of said paint cartridge in said feed tube passage hole;

a coating step of supplying paint from the loaded paint cartridge to said rotary atomizing head being put in high speed rotation;

a paint cartridge unloading step of unloading said paint cartridge from said housing after finishing a predetermined coating operation; and a washing step of supplying a washing fluid to the front side of said rotary atomizing head to wash away deposited residues of a previous color therefrom.

2. A coating method by the use of a rotary atomizing head type coating system including: a housing having a coating machine mounting portion on the front side and a cartridge mounting portion on the rear side thereof; a coating machine adapted to be mounted on said coating machine mounting portion of said housing, and having an air motor with a rotational shaft and a rotary atomizing head mounted on a front end portion of said air motor; a feed tube passage hole provided internally of and axially through said rotational shaft of said air motor, and having a front end opened into said rotary atomizing head and a rear end opened into said cartridge mounting portion of said housing; and a plural number of paint cartridges having paint of different colors filled in respective cylinders, and having a feed tube extended axially forward from a front end portion of said cylinder; characterized in that said coating method comprises:

a paint cartridge loading step of loading a selected one of said paint cartridges, setting said paint cartridge cylinder in position in said cartridge mounting portion of said housing, and placing said feed tube of said paint cartridge in said feed tube passage hole;

a coating step of supplying paint in the loaded paint cartridge through said feed tube to said rotary atomizing head being put in high speed rotation;

a washing step of supplying a washing fluid to the front side of said rotary atomizing head after finishing a predetermined coating operation in said coating state to wash away deposited residues of a previous color from said rotary atomizing head and fore end portions of said feed tube; and a paint cartridge unloading step of unloading said paint cartridge from said housing after finishing washing in said washing step.

3. A coating method by the use of a rotary atomizing head type coating system including: a housing having a coating machine mounting portion on the front side and a cartridge mounting portion on the rear side thereof; a coating machine adapted to be mounted on said coating machine mounting portion of said housing, and having an air motor with a rotational shaft and a rotary atomizing head mounted on a front end portion of said air motor; a feed tube passage hole provided internally of and axially through said rotational shaft of said air motor, and having a front end opened into said rotary atomizing head and a rear end opened into said cartridge mounting portion of said housing; a plural number of paint cartridges having paint of different colors filled in respective cylinders, and having a feed tube extended a axially forward from a front end portion of said cylinder; and a cleaning cartridge having a washing fluid filled in a cylinder thereof, and having a feed tube extended axially forward from a front end portion of said cylinder; characterized in that said coating method comprises:

a paint cartridge loading step of setting a selected one of said paint cartridges, setting said paint cartridge cylinder in position in said cartridge mounting portion of said housing, and placing said feed tube of said paint cartridge in said feed tube passage hole;

a coating step of supplying paint in the loaded paint cartridge through said feed tube to said rotary atomizing head being put in high speed rotation;

a paint cartridge unloading step of unloading said paint cartridge from said housing after finishing a predetermined coating operation in said coating step;

a cleaning cartridge loading step of setting a cleaning cartridge in position in said housing;

a washing step of supplying a washing fluid in said cleaning cartridge to said rotary atomizing head through said feed tube; and a cleaning cartridge unloading step of unloading said cleaning cartridge from said housing after finishing washing in said washing step.

* * * * *

UNITED STATES PATENT AND TRADEMARK OFFICE

CERTIFICATE OF CORRECTION

PATENT NO. : 6,179,217 B1
DATED : January 30, 2001
INVENTOR(S) : Osamu Yoshida et al.

It is certified that error appears in the above-identified patent and that said Letters Patent is hereby corrected as shown below:

Title page,
Item [30], Foreign Application Priority Data is incorrect. It should read as follows:

-- [30] Foreign Application Priority Data

Jan. 13, 1998 (JP) ……. 10-018227 --

Signed and Sealed this

Twenty-fourth Day of August, 2004

JON W. DUDAS
*Director of the United States Patent and Trademark Office*